US007542019B2

(12) United States Patent
Park et al.

(10) Patent No.: US 7,542,019 B2
(45) Date of Patent: Jun. 2, 2009

(54) LIGHT EMITTING DISPLAY

(75) Inventors: Sung Cheon Park, Suwon (KR); Won Kyu Kwak, Seongnam (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 626 days.

(21) Appl. No.: 11/274,041

(22) Filed: Nov. 14, 2005

(65) Prior Publication Data

US 2006/0125807 A1 Jun. 15, 2006

(30) Foreign Application Priority Data

Nov. 22, 2004 (KR) ..... 10-2004-0095979
Nov. 22, 2004 (KR) ..... 10-2004-0095980

(51) Int. Cl.
*G09G 3/32* (2006.01)

(52) U.S. Cl. ..... 345/82; 345/205

(58) Field of Classification Search ..... 345/82, 345/205, 206

See application file for complete search history.

(56) References Cited

U.S. PATENT DOCUMENTS 5,952,789 A * 9/1999 Stewart et al. ..... 315/169.4
6,323,598 B1 11/2001 Guthrie et al.
6,421,033 B1 7/2002 Williams et al.
6,919,681 B2 7/2005 Cok et al.
2002/0021293 A1 2/2002 Tam
2002/0109457 A1 8/2002 Duineveld et al.
2003/0214469 A1* 11/2003 Kageyama et al. ..... 345/82
2004/0070557 A1 4/2004 Asano et al.
2005/0024305 A1* 2/2005 Park ..... 345/82
2005/0062696 A1* 3/2005 Lo ..... 345/82
2005/0093791 A1 5/2005 Lo
2006/0097965 A1 5/2006 Deane et al.

FOREIGN PATENT DOCUMENTS

JP 2002-215096 7/2002

OTHER PUBLICATIONS

Patent Abstracts of Japan, Publication No. 2002-215096; Publication Date Jul. 31, 2002; in the name of Kwon.

(Continued)

*Primary Examiner*—Richard Hjerpe
*Assistant Examiner*—Shaheda A Abdin
(74) *Attorney, Agent, or Firm*—Christie, Parker & Hale, LLP

(57) ABSTRACT

A light display includes scan lines arranged in a row direction to transmit scan signals, a data line arranged in a column direction to transmit a data signal, an image display unit including emission control lines arranged in the row direction to transmit emission control signals, and a pixel in a region defined by the scan lines and the data line. The pixel has a driving circuit for receiving the signals, the data signal, the emission control signals, and a power to drive a current, a switching circuit connected with the driving circuit to receive the current, the switching circuit for selectively applying the current in accordance with the emission control signals, and organic light emitting diodes (OLEDs) positioned on different rows of the image display unit and connected with the switching circuit to receive the current in accordance with an operation of the switching circuit and to emit light.

30 Claims, 15 Drawing Sheets

OTHER PUBLICATIONS

SIPO Office action dated Sep. 21, 2007, for corresponding Chinese Application 2005101268174, with English translation, indicating relevance of listed U.S. Appl. No. 6,421,033 and U.S. Publication 2004/0070557 in this IDS.

U.S. Office action dated Dec. 1, 2008, for related U.S. Appl. No. 11/274,062, indicating relevance of remaining listed U.S. references in this IDS.

Patent Abstracts of Japan, Publication No. 2003-043999, dated Feb. 14, 2003, in the name of Suzuki.

* cited by examiner

<1st SUB FIELD>

<3rd SUB FIELD>

<2nd SUB FIELD>

<4th SUB FIELD>

LIGHT EMITTING DISPLAY

CROSS-REFERENCE TO RELATED APPLICATIONS

This application claims priority to and the benefit of Korean Patent Application Nos. 10-2004-95979 and 10-2004-95980, filed on Nov. 22, 2004, in the Korean Intellectual Property Office, the entire contents of which are incorporated herein by reference.

BACKGROUND

1. Field of the Invention

The present invention relates to a light emitting display, and more particularly, to a light emitting display capable of compensating for threshold voltages of transistors and capable of having a plurality of organic light emitting diodes (OLED) that emit light through one pixel circuit.

2. Discussion of Related Art

Recently, various flat panel displays having weight and volume less than comparable cathode ray tube (CRT) displays have been developed. In particular, light emitting displays having high luminous efficiency, high brightness, wide view angle, and high response speed are in the limelight An organic light emitting diode (OLED) has a structure in which an emission layer that is a thin film for emitting light is positioned between a cathode electrode and an anode electrode. Electrons and holes are injected into the emission layer so that they can be re-combined to generate exciters that emit light when their energies are reduced.

FIG. 1 illustrates a structure of a part of a conventional light emitting display. Referring to FIG. 1, four pixels are adjacent to each other and each pixel includes an OLED and a pixel circuit. The pixel circuit includes a first transistor T1, a second transistor T2, a third transistor T3, and a capacitor Cst. Each of the first, second, and third transistors T1, T2, and T3 includes a gate, a source, and a drain; and the capacitor Cst includes a first electrode and a second electrode.

Since the pixels have the same structure, only the pixel on the left top will be described in more detail. The source of the first transistor T1 is connected with a power source Vdd, the drain of the first transistor T1 is connected with the source of the third transistor M3, and the gate of the first transistor T1 is connected with a node A. The node A is connected with the drain of the second transistor T2. The first transistor T1 supplies a current corresponding to a data signal to the OLED.

The source of the second transistor T2 is connected with a data line D1, the drain of the second transistor T2 is connected with the node A, and the gate of the second transistor T2 is connected with a scan line S1. The second transistor T2 applies a data signal to the node A in accordance with a scan signal applied to the gate thereof.

The source of the third transistor T3 is connected with the drain of the first transistor T1, the drain of the third transistor T3 is connected with an anode electrode of the OLED, and the gate of the third transistor T3 is connected with an emission control line E1 to respond to an emission control signal. Therefore, the third transistor T3 controls the flow of a current that flows from the first transistor T1 to the OLED in accordance with the emission control signal to control emission of the OLED.

The first electrode of the capacitor Cst is connected with the power source Vdd, and the second electrode of the capacitor Cst is connected with the node A. The capacitor Cst stores charges in accordance with the data signal and applies a signal to the gate of the first transistor T1 by the stored charges for one frame so that the operation of the first transistor T1 is maintained for one frame.

However, according to the pixel used for the conventional light emitting display, since one OLED is connected with one pixel circuit, a plurality of pixel circuits are needed in order to emit light from a plurality of OLEDs so that a large number of the pixel circuits are needed.

Also, since one emission control line needs to be connected with a pixel row, the aperture ratio of the light emitting display deteriorates due to the emission control line.

SUMMARY OF THE INVENTION

Accordingly, an embodiment of the present invention provides a pixel and a light emitting display using the same, in which threshold voltages of transistors are compensated so that a uniform current for uniform brightness flows to an organic light emitting diode (OLED) in spite of a deviation in the threshold voltages. An embodiment of the present invention provides a plurality of OLEDs and a light emitting display using the same that emit light through one pixel circuit so that the embodiment can reduce the number of pixel circuits of the light emitting display, the number of data lines, and the number of pixel power source lines, to reduce the size of a data driving part, and to thus improve aperture ratio. An embodiment of the present invention provides a pixel and a light emitting display using the same capable of controlling points of emission time of a plurality of the OLEDs to minimize color breakup.

One embodiment of the present invention provides a light emitting display having first and second scan lines arranged in a row direction to transmit first and second scan signals, a data line arranged in a column direction to transmit a data signal, an image display unit including first and second emission control lines arranged in the row direction to transmit first and second emission control signals, respectively, and a pixel formed in a region defined by the first and second scan lines and the data line. The pixel has a driving circuit for receiving the first and second scan signals, the data signal, the first and second emission control signals, and a first power of a first power source to drive a current, a switching circuit connected with the driving circuit to receive the current, the switching circuit for selectively applying the current in accordance with the first and second emission control signals, and first and second organic light emitting diodes (OLEDs) positioned on two different rows of the image display unit and connected with the switching circuit to receive the current in accordance with an operation of the switching circuit and to emit light. The driving circuit has a first transistor for receiving the first power of the first power source and for supplying the current to the first and second OLEDs, the current corresponding to a voltage applied to a gate of the first transistor, a second transistor for selectively applying the data signal to a first electrode of the first transistor in accordance with the first scan signal, a third transistor for selectively forming an electrical connection between a second electrode of the first transistor and the gate of the first transistor in accordance with the first scan signal, a capacitor for storing the voltage applied to the gate of the first transistor while the data signal is applied to the first electrode of the first transistor and for maintaining the stored voltage at the gate of the first transistor for a predetermined time period when at least one the first and second OLEDs emits light, a fourth transistor for selectively applying an initializing signal to the capacitor in accordance with the second scan signal, a fifth transistor for selectively applying the first power of the first power source to the first transistor in accordance with the first emission control signal, and a sixth transistor for selectively applying the first power source to the first transistor in accordance with the second emission control signal.

One embodiment of the present invention provides a light emitting display having first and second scan lines arranged in a row direction to transmit first and second scan signals, a data line arranged in a column direction to transmit a data signal, an image display unit including first and second emission control lines arranged in the row direction to transmit first and second emission control signals, respectively, and a pixel formed in a region defined by the first and second scan lines and the data line. The pixel has a driving circuit for receiving the first and second scan signals, the data signal, the first and second emission control signals, and the first power of a first power source to drive a current, a switching circuit connected with the driving circuit to receive the current, the switching circuit for selectively applying the current in accordance with the first and second emission control signals, and first and second organic light emitting diodes OLEDs positioned on two different rows of the image display unit and connected with the switching circuit to receive the current in accordance with an operation of the switching circuit and to emit light. The driving circuit has a first transistor having first and second electrodes connected with first and second nodes, respectively, and having a third electrode connected with a third node, a second transistor having first and second electrodes connected with the data line and the second node, respectively, and having a third electrode connected with the first scan line, a third transistor having first and second electrodes connected with the first and third nodes, respectively, and having a third electrode connected with the first scan line, a fourth transistor having first and second electrodes connected with the third node and an initializing signal line, respectively, and having a third electrode connected with the second scan line, and a capacitor having a first electrode connected with the first power source and a second electrode connected with the third node, a fifth transistor having first and second electrodes connected with the second node and the first power source, respectively, and having a third electrode connected with the first emission control line, and a sixth transistor having first and second electrodes connected with the second node and the first power source, respectively, and having a third electrode connected with the second emission control line.

One embodiment of the present invention provides a light emitting display having first and second scan lines arranged in a row direction to transmit first and second scan signals, a data line arranged in a column direction to transmit a data signal, an image display unit including first and second emission control lines arranged in the row direction to transmit first and second emission control signals, respectively, and a pixel formed in a region defined by the first and second scan lines and the data line. The pixel has a driving circuit for receiving the first and second scan signals, the data signal, the first and second emission control signals, and the first power of a first power source to drive a current, a switching circuit connected with the driving circuit to receive the current, the switching circuit for selectively applying the current in accordance with the first and second emission control signals, and first and second organic light emitting diodes OLEDs positioned on two different rows of the image display unit and connected with the switching circuit to receive the current in accordance with an operation of the switching circuit and to emit light. The driving circuit has a first transistor having first and second electrodes connected with first and second nodes, respectively, and having a third electrode connected with a third node, a second transistor having first and second electrodes connected with a data line and the first node, respectively, and having a third electrode connected with the first scan line, a third transistor having first and second electrodes connected with the second and third nodes, respectively, and having a third electrode connected with the first scan line, a fourth transistor having first and second electrodes connected with the third node and an initializing signal line, respectively, and having a third electrode connected with a second scan line, and a capacitor having a first electrode connected with the first power source and a second electrode connected with the third node, a fifth transistor having first and second electrodes connected with the second node and the first power source, respectively, and having a third electrode connected with the first emission control line, and a sixth transistor having first and second electrodes connected with the second node and the first power source, respectively, and having a third electrode connected with the second emission control line.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, rather than restrictive.

Figure 1:
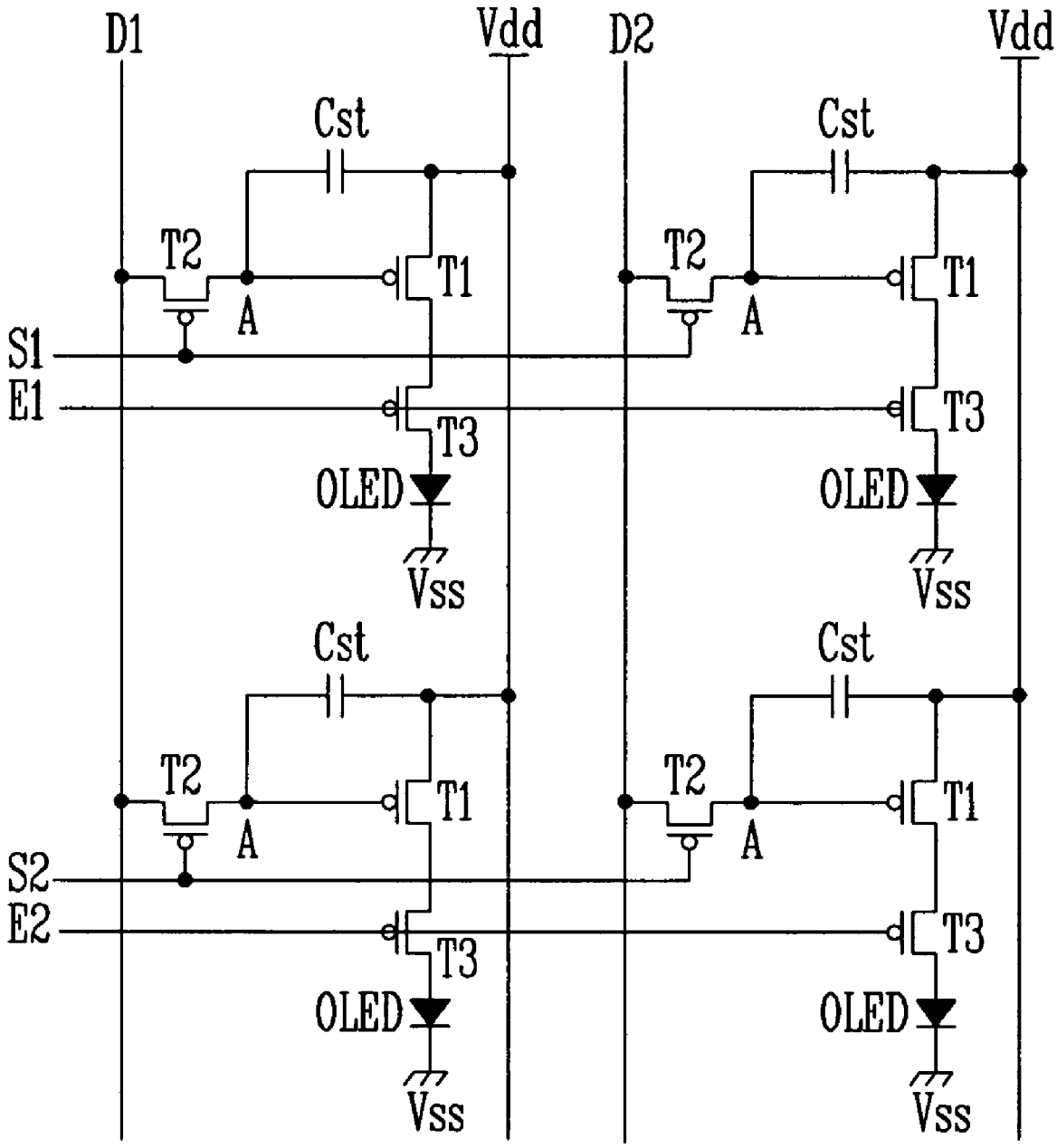
FIG. 1 (PRIOR ART)
FIG. 1 illustrates a structure of a part of a conventional light emitting display.
Figure 2:
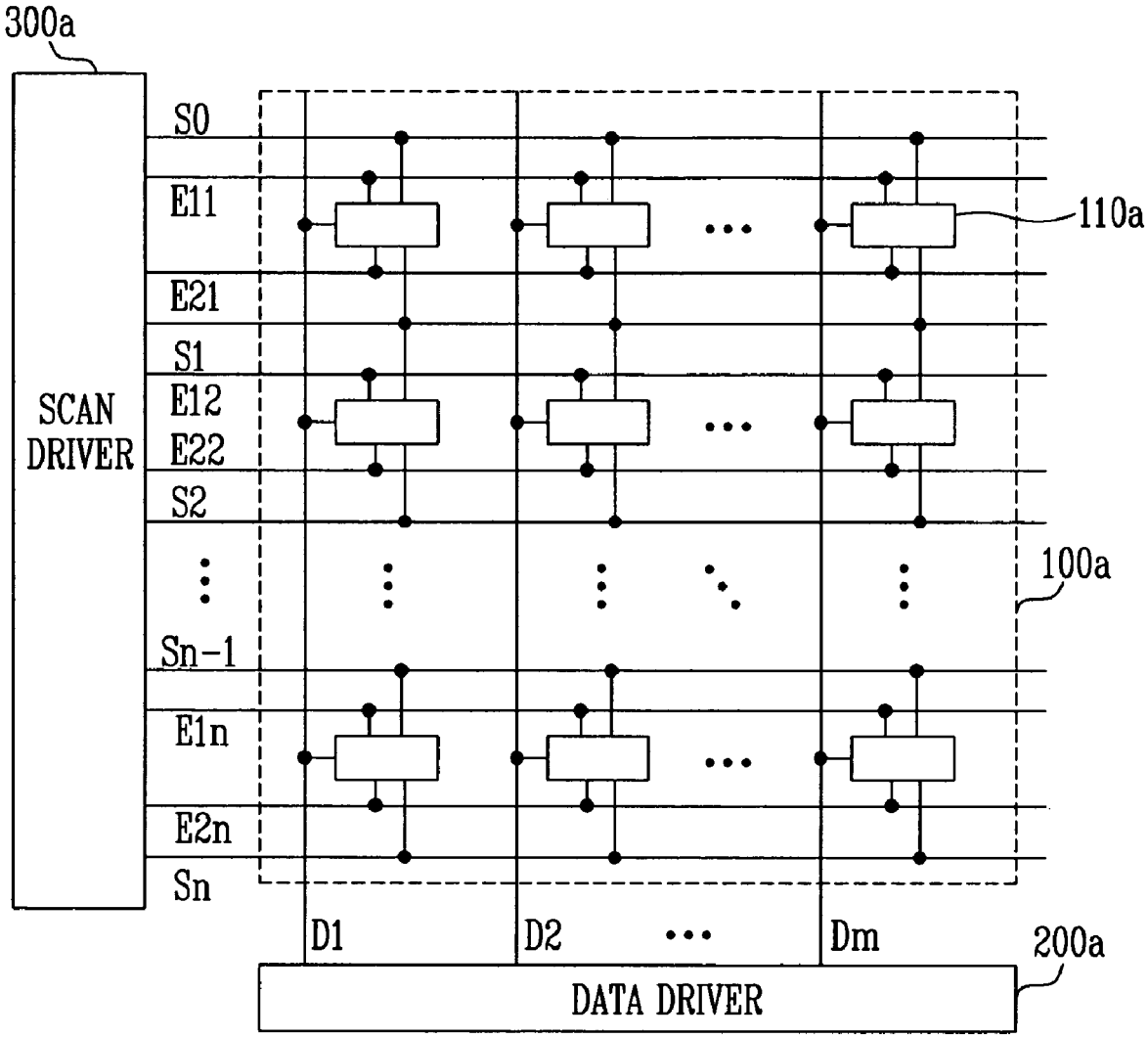
FIG. 2 illustrates a structure of a light emitting display of a first embodiment of the present invention.

FIG. 2 illustrates a structure of a light emitting display of a first embodiment of the present invention. Referring to FIG. 2, the light emitting display includes an image display unit 100*a*, a data driver 200*a*, and a scan driver 300*a*.

The image display unit 100*a* includes a plurality of scan lines S0, S1, S2, . . . , Sn−1, and Sn arranged in a row direction, a plurality of first emission control lines E11, E12, . . . , E1*n*−1, and E1*n* and a plurality of second emission control lines E21, E22, . . . , E2*n*−1, and E2*n* arranged in the row direction, a plurality of data lines D1, D2, . . . , Dm−1, and Dm arranged in a column direction, a plurality of pixel power source lines (not shown) for supplying pixel power from a pixel power source, and a plurality of pixel circuits 110*a*. In the present embodiment, first and second OLEDs (not shown) are connected with each pixel circuit 110*a*.

Scan signals, data signals, and the pixel power transmitted from the scan lines S0, S1, S2, . . . , Sn−1, and Sn, the data lines D1, D2, . . . , Dm−1, and Dm, and the pixel power source lines are transmitted to the pixel circuits 110*a* so that second transistors (not shown) included in the pixel circuits 110*a* generate driving currents corresponding to the data signals. The driving currents are transmitted to the OLEDs in accordance with first and second emission control signals transmitted by the first emission control lines E11, E12, . . . , E1*n*−1, and E1*n* and the second emission control lines E21, E22, . . . , E2*n*−1, and E2*n* so that an image is displayed.

The first and second OLEDs are connected with one pixel circuit 110*a* and are positioned on a same column but on different rows. The first and second OLEDs emit the same color.

Therefore, since a current is supplied to two OLEDs, i.e., the first and second OLEDs through one pixel circuit 110*a*, the number of pixel circuits 110*a* can be reduced and thus improve an aperture ratio of the image display unit 100*a*. Since the first and second OLEDs emit the same color and are positioned on the same column, the same color data signal is input through one data line, and gamma correction can be more easily performed.

The data driver 200*a* is connected with the data lines D1, D2, . . . , Dm−1, and Dm to transmit data signals to the image display unit 100*a*.

The scan driver 300*a* is formed on a side of the image display unit 100*a* and is connected with the scan lines S0, S1, S2, . . . , Sn−1, and Sn, the first emission control lines E11, E12, . . . , E1*n*−1, and E1*n*, and the second emission control lines E21, E22, E2*n*−1, and E2*n* to apply the scan signals and the first and second emission control signals to the image display unit 100*a*, thus sequentially selecting the rows of the image display unit 100*a*. Then, the data signals are applied to the selected rows by the data driver 200*a* so that the pixel circuit 110*a* emits light in accordance with the data signals and the first and second emission control signals.

Figure 3:
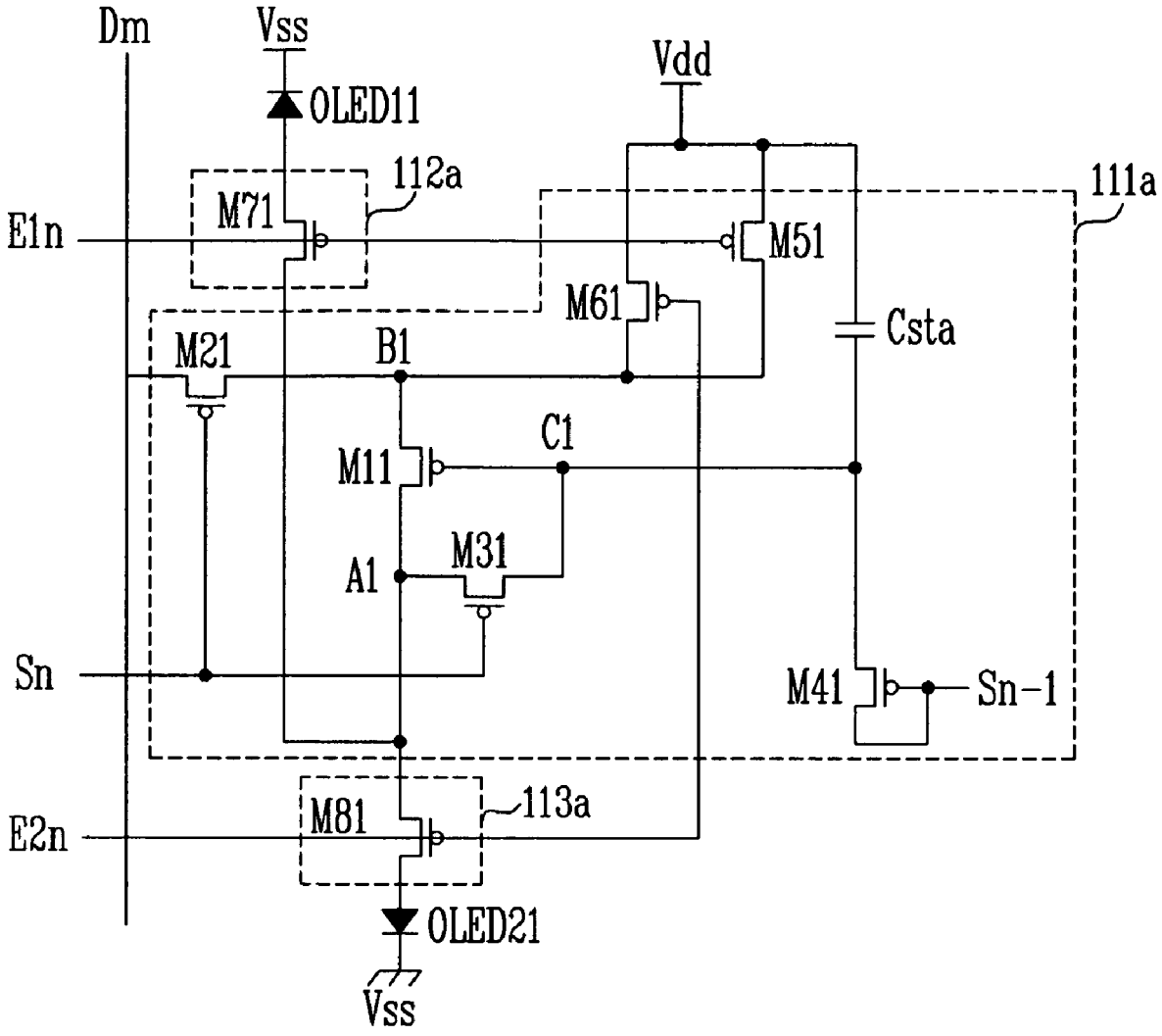
FIG. 3 is a circuit diagram illustrating a first embodiment of a pixel of the light emitting display of FIG. 2.

FIG. 3 is a circuit diagram illustrating a first embodiment of a pixel of the light emitting display of FIG. 2 according to the present invention. Referring to FIG. 3, the pixel includes a pixel circuit (e.g., the pixel circuit 110*a*) and OLEDs.

The pixel circuit includes a driving circuit 111*a*, a first switching circuit 112*a*, and a second switching circuit 113*a*. The driving circuit 111*a* includes first, second, third, fourth, fifth, and sixth transistors M11, M21, M31, M41, M51, and M61 and a capacitor Csta. The first switching circuit 112*a* includes a seventh transistor M71. The second switching circuit 113*a* includes an eighth transistor M81. Each transistor includes a source, a drain, and a gate. The capacitor Csta includes a first electrode and a second electrode.

Since the drains and the sources of the first to eighth transistors M11 to M81 have no physical difference, each source and drain may be referred to as a first electrode and a second electrode.

The source of the first transistor M11 is connected with a first node A1, the drain of the first transistor M11 is connected with a second node B1, and the gate of the first transistor M11 is connected with a third node C1 so that a current flows from the first node A1 to the second node B1 in accordance with a voltage of the third node C1.

The source of the second transistor M21 is connected with a data line Dm, the drain of the second transistor M21 is connected with the second node B1, and the gate of the second transistor M21 is connected with a first scan line Sn so that the second transistor M21 performs a switching operation in accordance with a first scan signal sn transmitted through the first scan line Sn to selectively apply a data signal transmitted through the data line Dm to the second node B1.

The source of the third transistor M31 is connected with the third node C1, the drain of the third transistor M31 is connected with the first node A1, and the gate of the third transistor M31 is connected with the first scan line Sn so that the potential of the first node A1 is made equal to the potential of the third node C1 by the first scan signal sn transmitted through the first scan line Sn. Therefore, the first transistor M11 can be connected like a diode for an electric current to flow through the first transistor M11 (in one direction).

The source and gate of the fourth transistor M41 are connected with a second scan line Sn−1, and the drain of the fourth transistor M41 is connected with the third node C1 so that the fourth transistor M41 transmits an initializing signal to the third node C1. The initial signal is a second scan signal sn−1 input to select the row that precedes by one row the row to which the first scan signal sn is input to select. That is, the second scan line Sn−1 refers to the scan line connected with the row that precedes the row to which the first scan line Sn is connected by one row.

The source of the fifth transistor M51 is connected with a pixel power source Vdd, the drain of the fifth transistor M51 is connected with the second node B1, and the gate of the fifth transistor M51 is connected with a first emission control line E1*n* so that the fifth transistor M51 selectively applies a pixel power of the pixel power source Vdd to the second node B1 in accordance with a first emission control signal e1*n* transmitted through the first emission control line E1*n*.

The source of the seventh transistor M71 is connected with the first node A1, the drain of the seventh transistor M71 is connected with a first OLED OLED11, and the gate of the seventh transistor M71 is connected with the first emission control line E1*n* so that the seventh transistor M71 applies a current input through the first node A1 to the first OLED OLED11 in accordance with the first emission control signal e1*n* transmitted through the first emission control line E1*n*.

The source of the sixth transistor M61 is connected with the pixel power source Vdd, the drain of the sixth transistor M61 is connected with the second node B1, and the gate of the sixth transistor M61 is connected with a second emission control signal E2*n* so that the sixth transistor M61 selectively applies the pixel power of the pixel power source Vdd to the second node B1 in accordance with a second emission control signal e2*n* transmitted through the second emission control signal E2*n*.

The source of the eighth transistor M81 is connected with the first node A1, the drain of the eighth transistor M81 is connected with a second OLED OLED21, and the gate of the eighth transistor M81 is connected with the second emission control line E2*n* so that the eighth transistor M81 applies a current input through the first node A1 to the second OLED OLED21 in accordance with the second emission control signal e2*n* transmitted through the second emission control line E2*n*.

The first electrode of the capacitor Csta is connected with the pixel power source Vdd, and the second electrode of the capacitor Csta is connected with the third node C1 so that the capacitor Csta is initialized by the initializing signal transmitted through the fourth transistor M41. The capacitor Csta maintains the voltage applied to the gate of the first transistor M11 for a predetermined time.

The OLEDs of the pixel of FIG. 3 include the first OLED OLED11 and the second OLED OLED21. The first OLED OLED11 and the second OLED OLED21 are connected with the seventh transistor M71 and the eighth transistor M81, respectively, to receive a current. The input of the current is controlled by the first emission control line E1*n* and the second emission control line E2*n*. The first OLED OLED11 and the second OLED OLED21 are positioned on the same column but on different rows.

Figure 4:
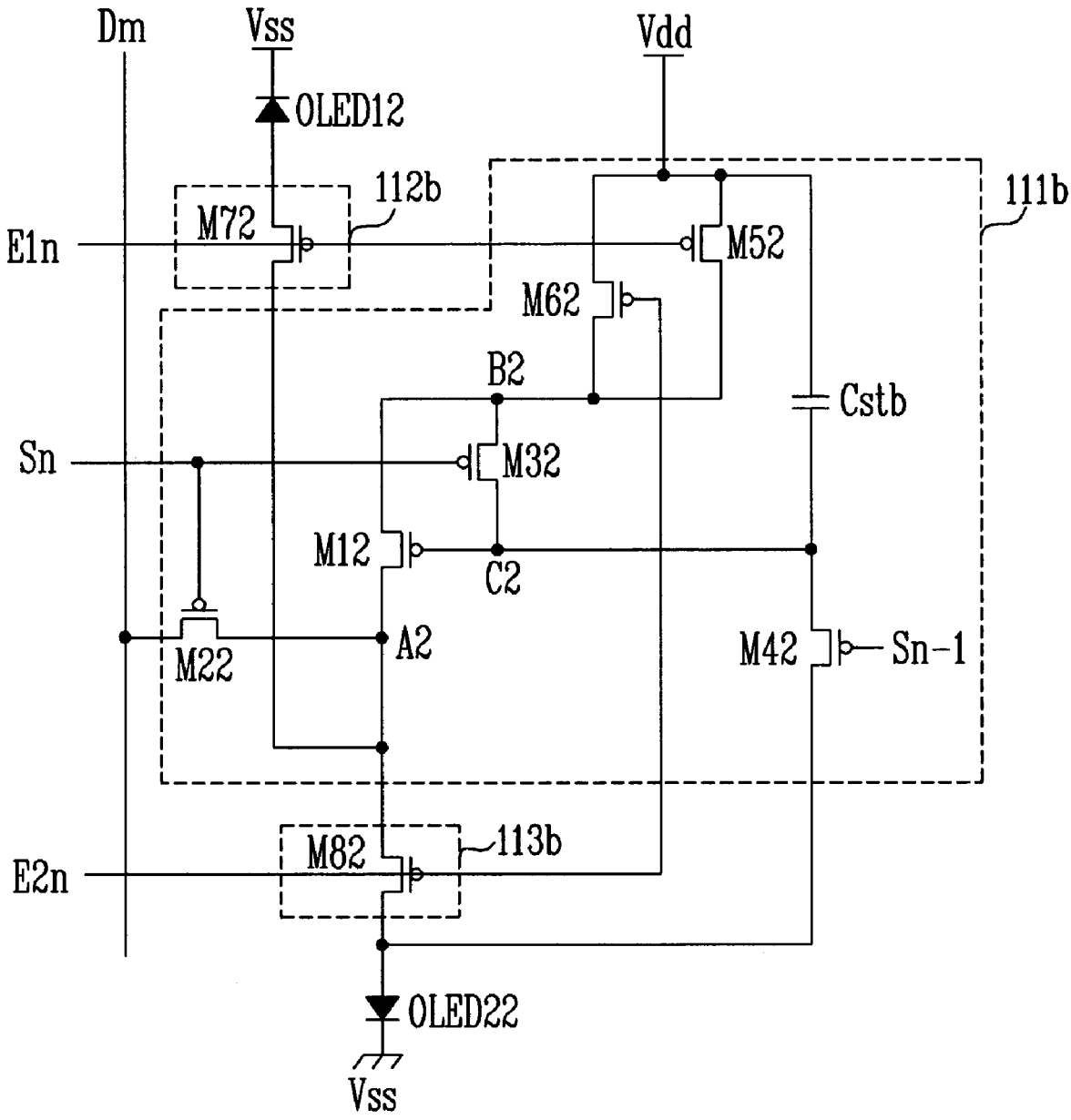
FIG. 4 is a circuit diagram illustrating a second embodiment of a pixel of the light emitting display of FIG. 2.

FIG. 4 is a circuit diagram illustrating a second embodiment of a pixel of the light emitting display of FIG. 2. Referring to FIG. 4, the pixel includes a pixel circuit and OLEDs.

The pixel circuit includes a driving circuit 111*b*, a first switching circuit 112*b*, and a second switching circuit 113*b*. The driving circuit 111*b* includes first, second, third, fourth, fifth, and sixth transistors M12, M22, M32, M42, M52, and M62 and a capacitor Cstb. The first switching circuit 112*b* includes a seventh transistor M72. The second switching circuit 113*b* includes an eighth transistor M82. Each transistor includes a source, a drain, and a gate. The capacitor Cstb includes a first electrode and a second electrode.

Since the drains and the sources of the first to eighth transistors M12 to M82 have no physical difference, each source and drain may be referred to as a first electrode and a second electrode.

The drain of the first transistor M12 is connected with a first node A 2, the source of the first transistor M12 is connected with a second node B2, and the gate of the first transistor M12 is connected with a third node C2 so that a current flows from the first node A2 to the second node B2 in accordance with a voltage of the third node C2.

The source of the second transistor M22 is connected with a data line Dm, the drain of the second transistor M22 is connected with the first node A2, and the gate of the second transistor M22 is connected with a first scan line Sn so that the second transistor M22 performs a switching operation in accordance with a first scan signal sn transmitted through the first scan line Sn to selectively apply a data signal transmitted through the data line Dm to the first node A2.

The source of the third transistor M32 is connected with the second node B2, the drain of the third transistor M32 is connected with the third node C2, and the gate of the third transistor M32 is connected with the first scan line Sn so that the potential of the second node B2 is made equal to the potential of the third node C2 by the first scan signal sn transmitted through the first scan line Sn. Therefore, the first transistor M12 can serve as a diode for an electric current to flow through the first transistor M12 (in one direction).

The source of the fourth transistor M42 is connected with an anode electrode of an OLED22, the gate of the fourth transistor M42 is connected with a second scan line Sn−1, and the drain of the fourth transistor M42 is connected with the third node C2. The fourth transistor M42 applies a voltage between the OLED22 and a cathode electrode Vss when no current flows through the OLED22 to the third node C2 in accordance with a second scan signal sn−1 transmitted by the second scan line Sn−1 and uses the voltage between the OLED22 and the cathode voltage Vss as an initializing signal.

The source of the fifth transistor M52 is connected with a pixel power source Vdd, the drain of the fifth transistor M52 is connected with the second node B2, and the gate of the fifth transistor M52 is connected with a first emission control line E1*n* so that the fifth transistor M52 selectively applies a pixel power of the pixel power source Vdd to the second node B2 in accordance with a first emission control signal e1*n* transmitted through the first emission control line E1*n*.

The source of the sixth transistor M62 is connected with the pixel power source Vdd, the drain of the sixth transistor M62 is connected with the second node B2, and the gate of the sixth transistor M62 is connected with a second emission control signal E2*n* so that the sixth transistor M62 selectively applies the pixel power of the pixel power source Vdd to the second node B2 in accordance with a second emission control signal e2*n* transmitted through the second emission control signal E2*n*.

The source of the seventh transistor M72 is connected with the first node A2, the drain of the seventh transistor M72 is connected with a first OLED OLED12, and the gate of the seventh transistor M72 is connected with the first emission control line E1*n* so that the seventh transistor M72 applies a current input through the first node A2 to the first OLED OLED12 in accordance with the first emission control signal e1*n* transmitted through the first emission control line E1*n*.

The source of the eighth transistor M82 is connected with the first node A2, the drain of the eighth transistor M82 is connected with a second OLED OLED22, and the gate of the eighth transistor M82 is connected with the second emission control line E2*n* so that the eighth transistor M82 applies a current input through the first node A2 to the second OLED OLED22 in accordance with the second emission control signal e2*n* transmitted through the second emission control line E2*n*.

The first electrode of the capacitor Cstb is connected with the pixel power source Vdd and the second electrode of the capacitor Cstb is connected with the third node C2 so that the capacitor Cstb is initialized by the initializing signal transmitted through the fourth transistor M42. The capacitor Cstb maintains the gate voltage of the first transistor M12 for a predetermined time.

The OLEDs of the pixel of FIG. 4 include the first OLED OLED12 and the second OLED OLED22. The first OLED OLED12 and the second OLED OLED22 are connected with the seventh transistor M71 and the eighth transistor M82, respectively, to receive a current. The input of the current is controlled by the first emission control line E1*n* and the second emission control line E2*n*. The first OLED OLED12 and the second OLED OLED22 are positioned on the same column but on different rows.

Figure 5:
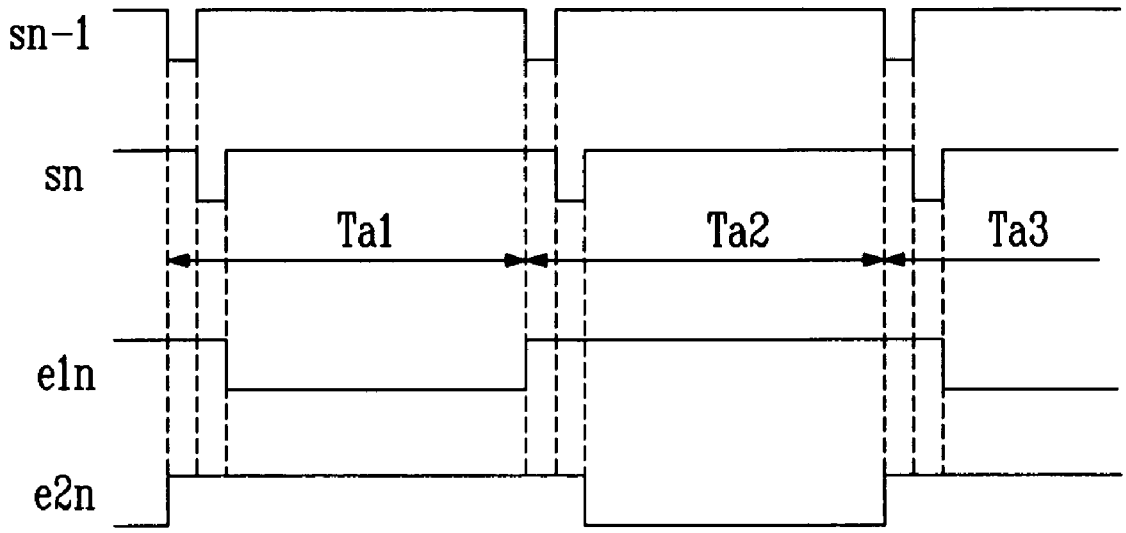
FIG. 5 is a timing diagram illustrating an operation of the pixels of FIGS. 3 and 4 according to an embodiment of the present invention.

FIG. 5 is a timing diagram illustrating an operation of the pixels of FIGS. 3 and 4. Referring to FIG. 5, each of the pixels is operated by a first scan signal sn, a second scan signal sn−1, a first emission control signal e1*n*, and a second emission control signal e2*n*. The operation of the pixel is divided into a first period T11 in which a first OLED OLED1 (e.g., OLED11 or OLED12) emits light and a second period Ta2 in which a second OLED OLED2 (e.g., OLED21 or OLED22) emits light.

In the first period Ta1, the second scan signal sn−1 is first transited from a high level to a low level while the first scan signal sn, the first emission control signal e1*n*, and the second emission control signal e2*n* are each maintained at the high level so that a fourth transistor M4 (e.g., M41 or M42) is turned on. Therefore, the initializing signal is transmitted to a third node C (e.g., C1 or C2) to initialize a capacitor Cst (e.g., Csta or Cstb). At this time, in FIG. 3, the initializing signal is formed by the second scan signal sn−1. In FIG. 4, the initializing signal is formed by the voltage applied to the OLEDs (e.g., OLED22) when seventh and eighth transistors MT (e.g., M72) and M8 (e.g., M82) are turned off by the first and second emission control signals e1*n* and e2*n*.

Then, after the second scan signal sn−1 is transited from the low level to the high level in the first period Ta1, the first scan signal sn is transmitted from the high level to the low level while the first and second emission control signals e1*n* and e2*n* are each maintained at the high level so that second and third transistors M2 (e.g., M21 or M22) and M3 (e.g., M31 or M32) are turned on. When the second and third transistors M2 and M3 are turned on, the potential of a first node A (e.g., A1) or a second node B (e.g., B2) is equal to the potential of a third node C (e.g., C1 or C2) so that an electric current flows through a first transistor M1 (e.g., M11 or M12) serving as a diode; so that the data signal transmitted through a data line is applied to the third node C through the first transistor M1 serving as the diode through which the electric current flows; and so that a voltage corresponding to a difference between the voltage of the data signal and the threshold voltage of the first transistor M is applied to a second electrode of the capacitor Cst.

After the first scan signal sn is transited to the high level and maintained at the high level for a predetermined time, when the first emission control signal e1*n* is transited to the low level and maintained at the low level for a predetermined time, the first scan signal sn, the second scan signal sn−1, and the second emission control signal e2*n* are each maintained at the high level while the first emission control signal e1*n* is in the low level. At this time, fifth and seventh transistors M5 (e.g., M51 or M52) and M7 (e.g., M71 or M72) are turned on by the first emission control signal e1*n* so that the voltage obtained by EQUATION 1 is applied between the gate and source of the first transistor M1.

$$Vsg = Vdd - (V\text{data} - |Vth|) \quad \text{[EQUATION 1]}$$

wherein, Vsg, Vdd, Vdata, and Vth represent the voltage between the source and the gate of the first transistor M1, a pixel power source voltage, the voltage of the data signal, and the threshold voltage of the first transistor M1, respectively.

The seventh transistor M7 is turned on so that the current obtained by EQUATION 2 flows to the OLED OLED1.

$$\begin{aligned} I_{OLED} &= \frac{\beta}{2}(Vgs - |Vth|)^2 \quad \text{[EQUATION 2]} \\ &= \frac{\beta}{2}(Vdata - Vdd + |Vth| - |Vth|)^2 \\ &= \frac{\beta}{2}(Vdata - Vdd) \end{aligned}$$

wherein, $I_{OLED}$, Vgs, Vdd, Vth, and Vdata represent the current that flows to the OLED OLED1, the voltage applied to the gate of the first transistor Ml, the voltage of the pixel power source, the threshold voltage of the first transistor M1, and the voltage of the data signal, respectively.

Therefore, as shown by EQUATION 2, the current flows to the first OLED OLED1 regardless of the threshold voltage of the first transistor M1.

In the second period Ta2, after the second scan signal sn−1 is again in the low level to initialize the capacitor Cst, the first scan signal sn is in the low level to transmit the data signal to the first node A (e.g., A1 or A2). An electric current flows through the first transistor M1 serving as a diode due to the third transistor M3 so that the voltage corresponding to the voltage of the data signal is stored in the capacitor Cst and that the voltage obtained by the EQUATION 1 is applied between the source and gate of the first transistor M1.

Then, when the second emission control signal e2*n* maintains the low level for a predetermined time, sixth and eighth transistors M6 (e.g., M61 or M62) and M8 (e.g., M81 or M82) are turned on so that the current obtained by the EQUATION 2 flows to the second OLED OLED2.

Therefore, the first and second OLEDs OLED1 and OLED2 connected with one pixel circuit sequentially emit light.

Figure 6:
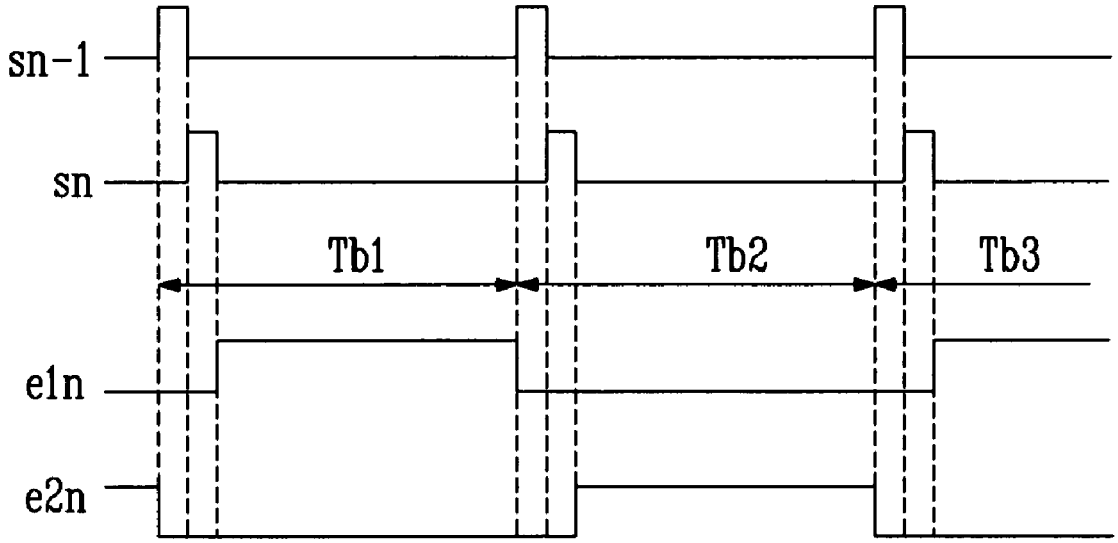
FIG. 6 is a timing diagram illustrating an operation of a case in which the pixels of FIGS. 3 and 4 are formed with NMOS transistors according to an embodiment of the present invention.

FIG. 6 is a timing diagram illustrating an operation of a case in which the pixels of FIGS. 3 and 4 are formed with NMOS transistors instead of PMOS transistors. Referring to FIG. 6, each of the pixels is operated by a first scan signal sn, a second scan signal sn−1, a first emission control signal e1*n*, and a second emission control signal e2*n*. The operation of the pixel is divided into a first period Tb1 in which a first OLED (e.g., OLED11 or OLED12) emits light and a second period Tb2 in which a second OLED (e.g., OLED21 or OLED22) emits light.

Figure 7:
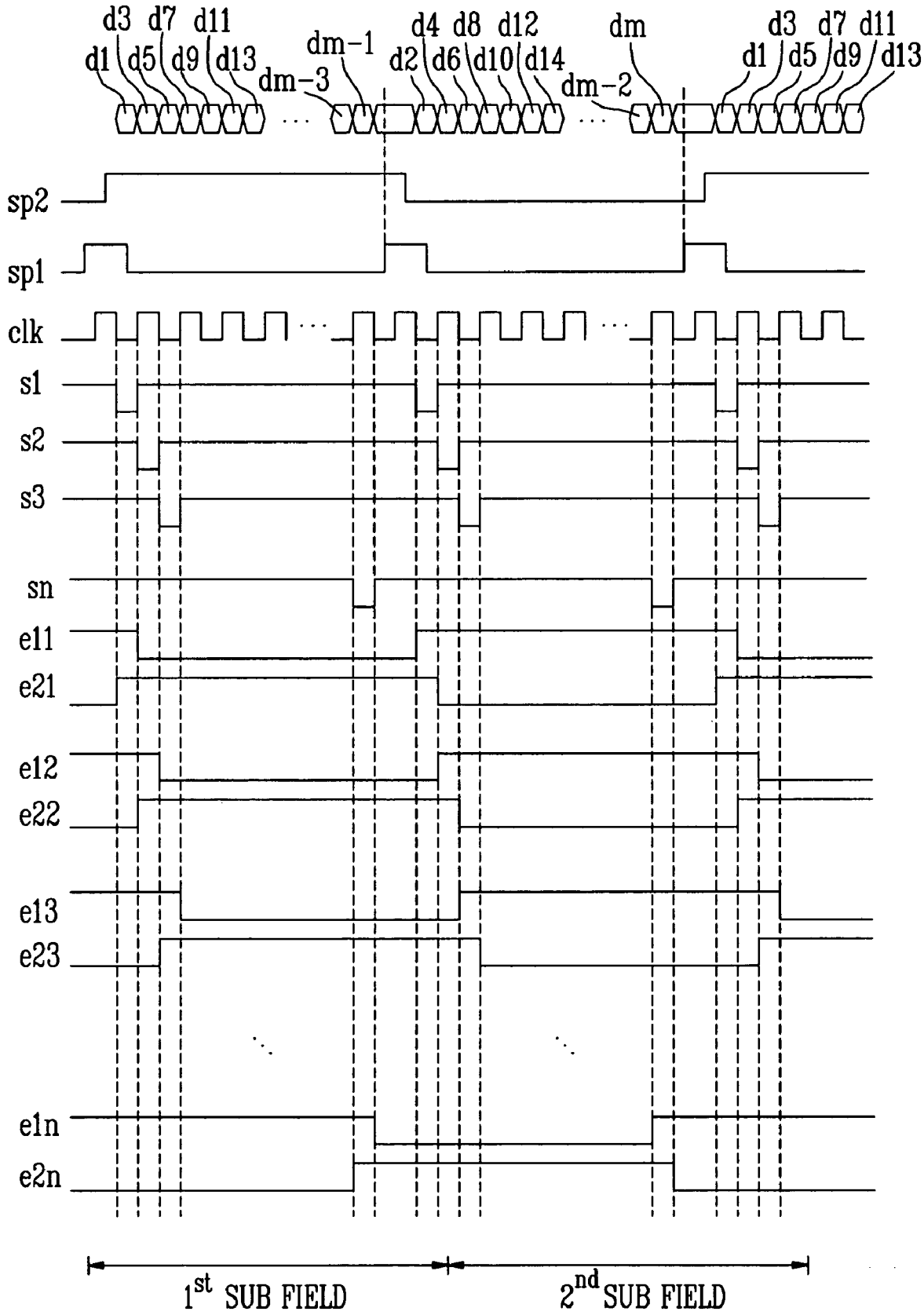
FIG. 7 is a timing diagram illustrating emission processes of a light emitting display according to an embodiment of the present invention.

FIG. 7 is a timing diagram illustrating emission processes of a light emitting display according to an embodiment of the present invention. Referring to FIG. 7, serially input data signals are divided into first data signals d1, d3, . . . , dm−3, and dm−1 input to odd rows and second data signals d2, d4, . . . , dm−2, and dm input to even rows. When the first data signals d1, d3, . . . , dm−3, and dm−1 are output from a data driver (e.g., the data driver 200*a*) and input to the odd rows, the second data signals d2, d4, . . . , dm−2, and dm are input to the data driver (e.g., the data driver 200*a*). Here, the numbers between 1 and refer to the row numbers of the light emitting display. A period in which the odd rows emit light is referred to as a first sub-field, and a period in which the even rows emit light is referred to as a second sub-field. One frame is composed of the first sub-field and the second sub-field.

Figure 8A:
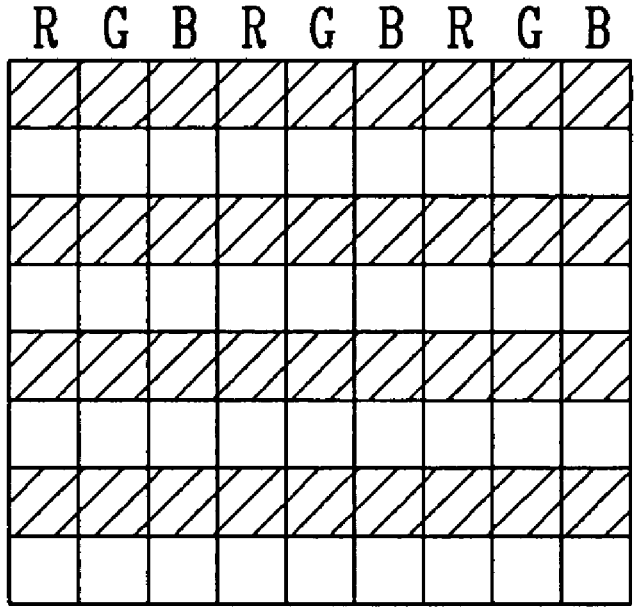
FIGS. 8A and 8B illustrate one frame of a light emitting display that is divided into two sub-fields.

In operation, the first data signals d1, d3, . . . , dm−3, and dm−1 are first sequentially input to the odd rows in accordance with scan signals (e.g., s1, s2, s3, . . . and sn). At this time, first emission control signals (e.g., e11, e12, e13, . . . e1*n*) are sequentially input so that a first OLED (e.g., OLED 11 or OLED 12) in each pixel circuit emits light and so that the odd rows emit light as a result. Therefore, referring to FIG. 8A, the first sub-field emits light as illustrated in FIG. 8A.

Figure 8B:
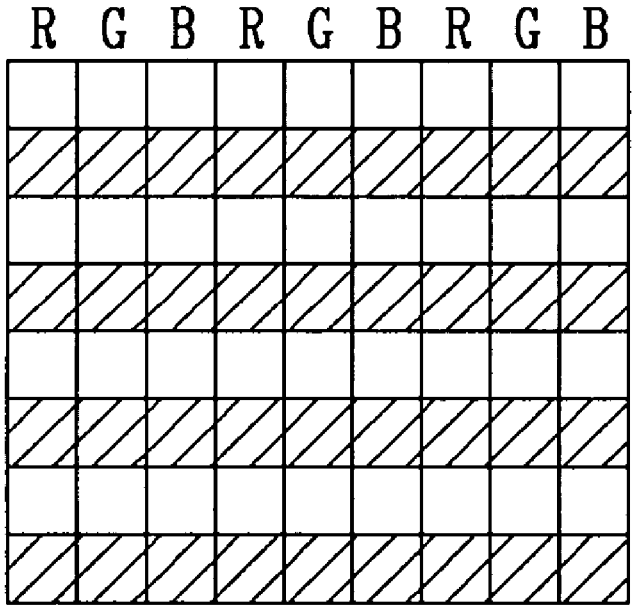

Then, the second data signals d2, d4, . . . , dm−2, and dm are sequentially input to the even rows in accordance with the scan signals. At this time, second emission control signals are sequentially input to the even rows so that a second OLED (e.g., OLED 21 or OLED 22) in each pixel circuit emits light and so that the even rows emit light as a result. Therefore, referring to FIG. 8B, the second sub-field emits light as illustrated in FIG. 8B.

When the first and second sub-fields emit light, all of the OLEDs emit light to complete one frame.

Figure 9:
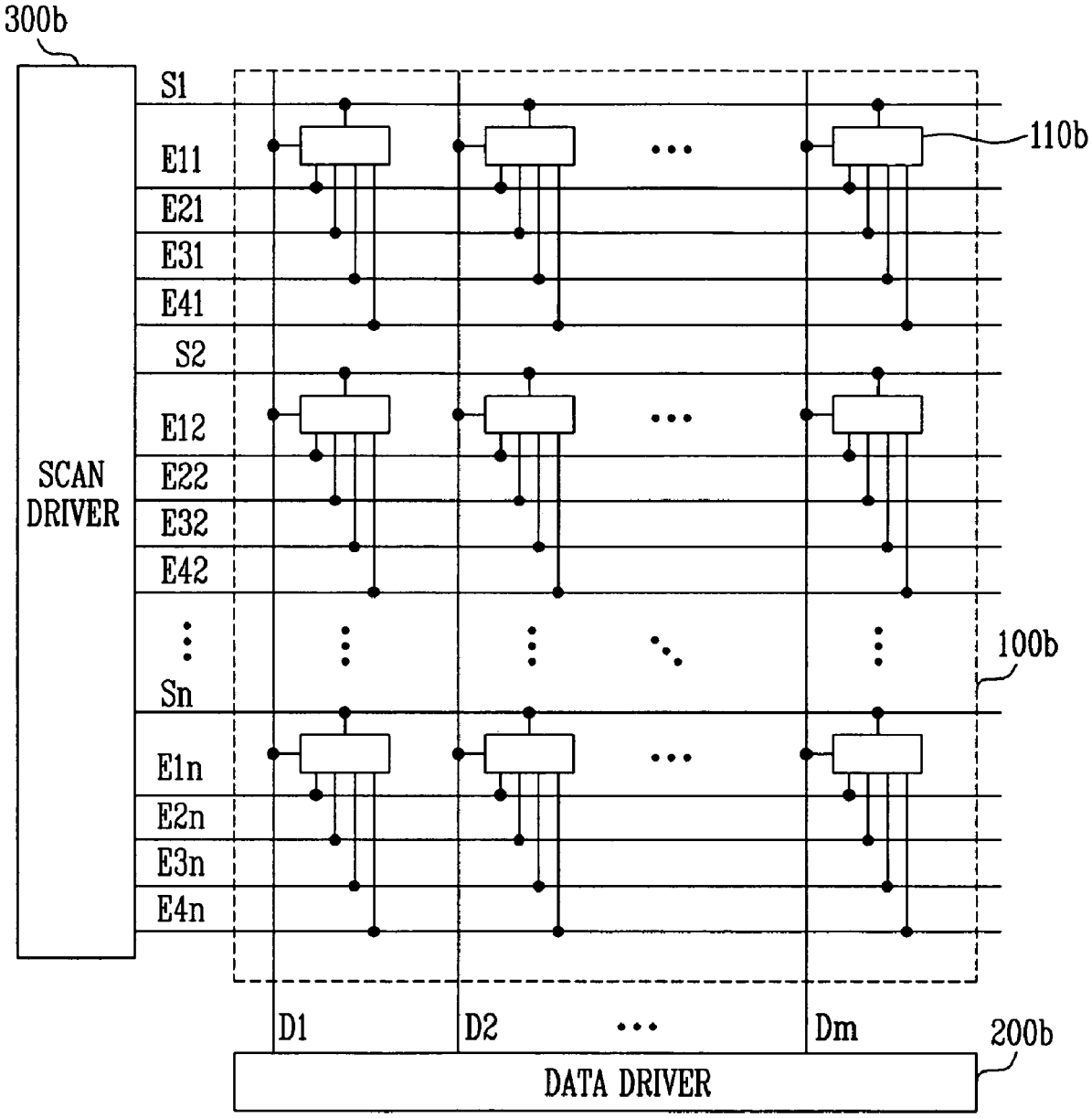
FIG. 9 illustrates a structure of a light emitting display of a second embodiment of the present invention.

FIG. 9 illustrates a structure of a light emitting display of a second embodiment of the present invention. Referring to FIG. 9, the light emitting display includes an image display unit 100*b*, a data driver 200*b*, and a scan driver 300*b*.

The image display unit 100*b* includes a plurality of pixel circuits 110*b*, a plurality of scan lines S1, S2, . . . , Sn−1, and Sn arranged in a row direction, a plurality of first emission control lines E11, E12, . . . , E1*n*−1, and E1*n*, second emission control lines E21, E22, . . . , E2*n*−1, and E2*n*, third emission control lines E31, E32, . . . , and E3*n*-1, and E3*n*, and fourth emission control lines E41, E42, . . . , E4*n*−1, and E4*n* arranged in the row direction, a plurality of data lines D1, D2, . . . , Dm−1, and Dm arranged in a column direction, and a plurality of pixel power source lines (not shown) for supplying pixel power. The pixel power source lines receive the pixel power from an outside pixel power source that supplies the pixel power.

The data signals transmitted from the data lines D1, D2, . . . , Dm−1, and Dm are transmitted to the pixel circuit 110*b* in accordance with scan signals transmitted from the scan lines S1, S2, . . . , Sn−1, and Sn and scan signals. The pixel circuits 110*b* generate currents corresponding to the data signals, and the currents are transmitted to the OLEDs in accordance with first, second, third and fourth emission control signals transmitted through the first emission control lines E11, E12, . . . , E1*n*−1, and E1*n* to the fourth emission control lines E41, E42, . . . , E4*n*−1, and E4*n* so that an image is displayed.

The data driver 200*b* is connected with the data lines D1, D2, . . . , Dm−1, and Dm to transmit the data signals to the image display unit 100*b*. The data driver 200*b* sequentially transmits red and green, green and blue, or blue and red data to one data line.

The scan driver 300*b* is formed on a side of the image display unit 100*b* and is connected with the plurality of scan lines S1, S2, . . . , Sn−1, and Sn and the plurality of first emission control lines E11, E12, . . . , E1*n*−1, and E1*n* to the fourth emission control lines E41, E42, . . . , E4*n*-1, and E4*n* so that the scan signals and the first, second, third and fourth emission control signals are transmitted to the image display unit 100*b*.

Figure 10:
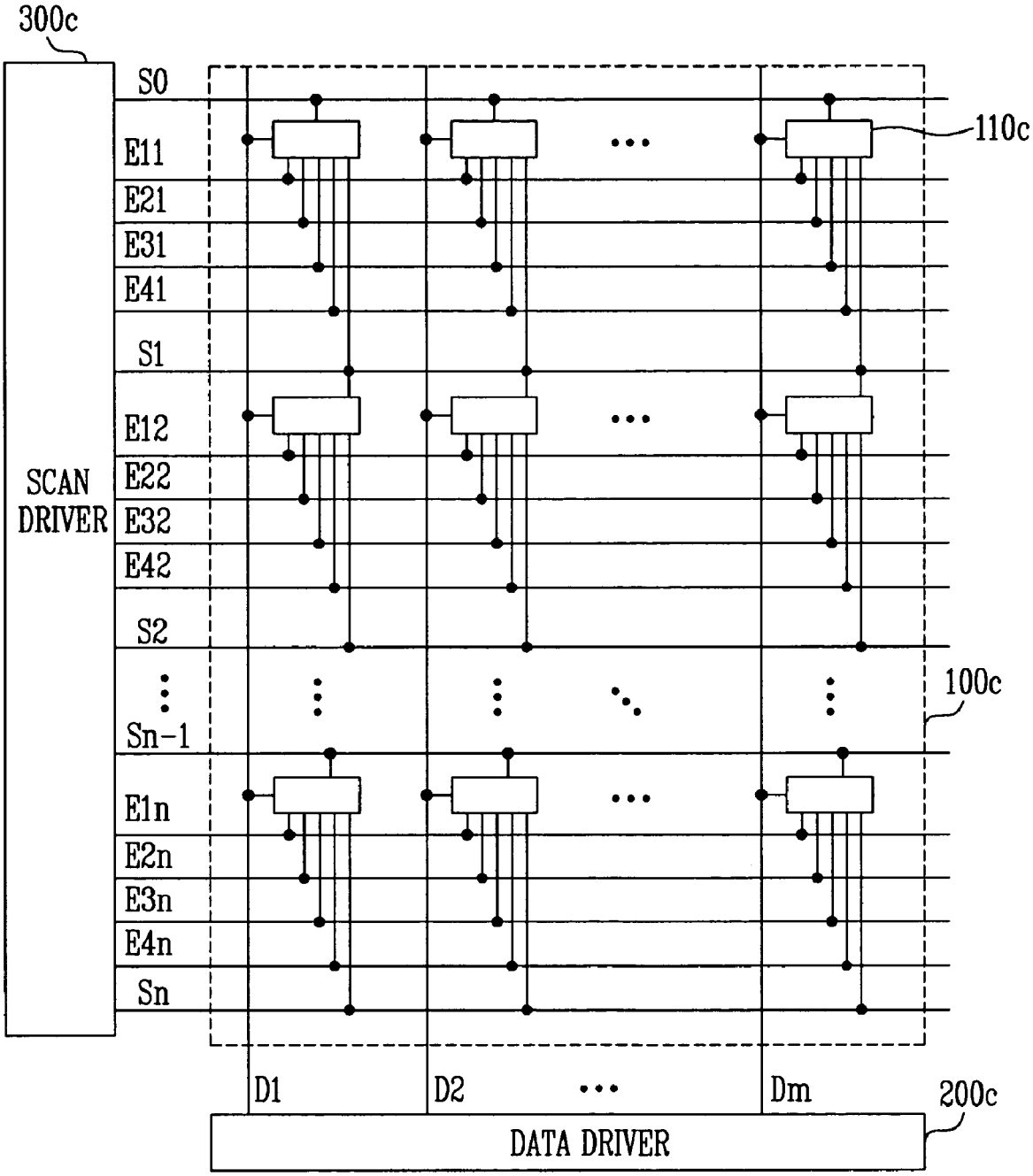
FIG. 10 illustrates a structure of a light emitting display of a third embodiment of the present invention.

FIG. 10 illustrates a structure of a light emitting display according to a third embodiment of the present invention. Referring to FIG. 10, the light emitting display includes an image display unit 100*c*, a data driver 200*c*, and a scan driver 300*c*.

The image display unit 100*c* includes a plurality of pixel circuits 110*c*, four OLEDs (not shown) connected with each of the pixel circuits 110*c*, a plurality of scan lines S0, S1, S2, . . . , Sn−1, and Sn arranged in a row direction, a plurality of first emission control lines E11, E12, . . . , E1*n*−1, and E1*n*, second emission control lines E21, E22, . . . , E2*n*−1, and E2*n*, third emission control lines E31, E32, . . . , and E3*n*-1, and E3*n*, and fourth emission control lines E41, E42, . . . , E4*n*−1, and E4*n* arranged in the row direction, a plurality of data lines D1, D2, . . . , Dm−1, and Dm arranged in a column direction, and a plurality of pixel power source lines (not shown) for supplying pixel power. The pixel power source lines receive the pixel power from an outside pixel power source that supplies the pixel power.

Each of the pixel circuits 110*c* receives a scan signal of a current scan line and a scan signal of a previous scan line through the scan lines S0, S1, S2, . . . , Sn−1, and Sn (e.g., Sn−1 and Sn) and generates currents corresponding to the data signals transmitted from the data lines D1, D2, . . . , Dm−1, and Dm. The driving currents are transmitted to the four OLEDs in accordance with first, second, third and fourth emission control signals transmitted through the first emission control signals E11, E12, . . . , E1*n*−1, and E1*n* to the fourth emission control lines E41, E42, . . . , E4*n*−1, and E4*n* so that an image is displayed.

The data driver 200*c* is connected with the data lines D1, D2, . . . , Dm−1, and Dm to transmit the data signals to the image display unit 100*c*. The data driver 200*c* sequentially transmits red and green, green and blue, or blue and red data to one data line.

The scan driver 300*c* is formed on a side of the image display unit 100*c* and is connected with the plurality of scan lines S0, S1, S2, . . . , Sn−1, and Sn and the plurality of first emission control lines E11, E12, . . . , E1*n*−1, and E1*n* to the fourth emission control lines E41, E42, . . . , E4*n*−1, and E4*n* so that the scan signals and the first, second, third and fourth emission control signals are transmitted to the image display unit 100*c*.

Figure 11:
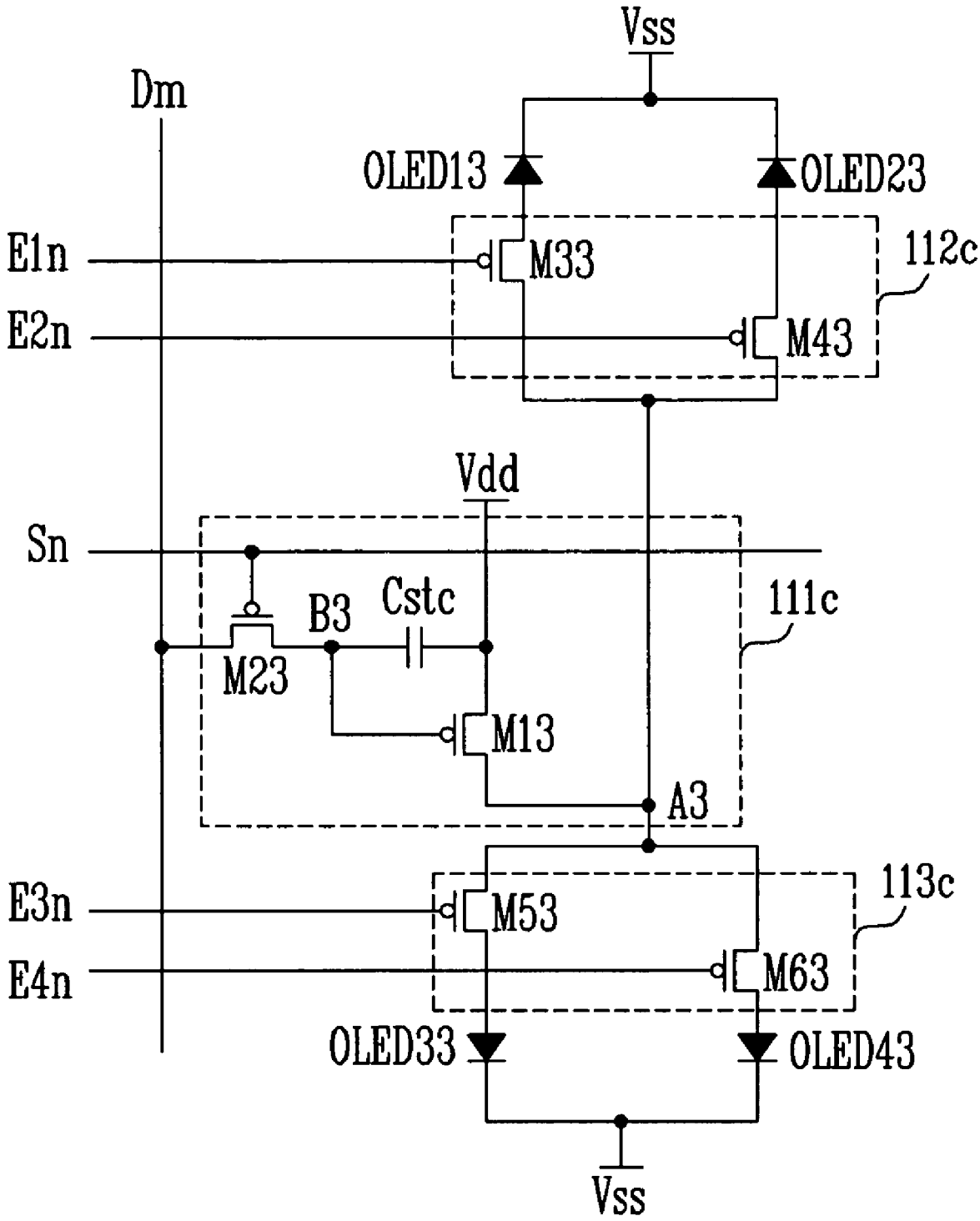
FIG. 11 is a circuit diagram illustrating an embodiment of a pixel of the light emitting display of FIG. 9.

FIG. 11 is a circuit diagram illustrating an embodiment of a pixel of the light emitting display of FIG. 9. Referring to FIG. 11, the pixel includes four OLEDs and a pixel circuit (e.g., the pixel circuit 110*b*). The four OLEDs OLED13, OLED23, OLED33, and OLED43 are connected with one pixel circuit. The pixel circuit (e.g., the pixel circuit 110*b*) includes a driving circuit 111*c*, a first switching circuit 112*c*, and a second switching circuit 113*c*.

The driving circuit 111*c* includes first and second transistors M13 and M23 and a capacitor Cstc. The first switching circuit 112*c* includes third and fourth transistors M33 and M43. The second switching circuit 113*c* includes fifth and sixth transistors M53 and M63.

Each of the first to sixth transistors M13 to M63 includes a source, a drain, and a gate. Since the drains and the sources of the first to sixth transistors M13 to M63 have no physical difference, each source and drain may be referred to as a first electrode and a second electrode. Also, the capacitor Cstc includes a first electrode and a second electrode. The four OLEDs are referred to as first to fourth OLEDs OLED13 to OLED43.

The source of the first transistor M13 is connected with a pixel power source line Vdd, the drain of the first transistor M13 is connected with a first node A3, and the gate of the first transistor M13 is connected with a second node B3 so that an amount of current that flows from the source of the first transistor M13 to the drain of the first transistor M13 is determined in accordance with a voltage applied to the gate of the first transistor M13.

The source of the second transistor M23 is connected with a data line Dm, the drain of the second transistor M23 is connected with the second node B3, and the gate of the second transistor M23 is connected with a scan line Sn so that the second transistor M23 performs on and off operations in accordance with a scan signal sn transmitted through the scan line Sn to selectively apply a data signal to the second node B3.

The source of the third transistor M33 is connected with the first node A3, the drain of the third transistor M33 is connected with the first OLED OLED13, and the gate of the third transistor M33 is connected with a first emission control line El n so that the third transistor M33 performs on and off operations in accordance with a first emission control signal e1*n* received through the first emission control line E1*n* to selectively apply the current that flows through the first node A3 to the first OLED OLED13.

The source of the fourth transistor M43 is connected with the first node A3, the drain of the fourth transistor M43 is connected with the second OLED OLED23, and the gate of the fourth transistor M43 is connected with a second emission control line E2*n* so that the fourth transistor M43 performs on and off operations in accordance with a second emission control signal e2*n* received through the second emission control line E2*n* to selectively apply the current that flows through the first node A3 to the second OLED OLED23.

The source of the fifth transistor M53 is connected with the first node A3, the drain of the fifth transistor M53 is connected with the third OLED OLED33, and the gate of the fifth transistor M53 is connected with a third emission control line E3 n so that the fifth transistor M53 selectively applies the current that flows from the source of the fifth transistor M53 to the drain of the fifth transistor M53, to the third OLED OLED33 in accordance with a third emission control signal e3*n* transmitted through the third emission control line E3*n* to emit light from the third OLED OLED33.

The source of the sixth transistor M63 is connected with the first node A3, the drain of the sixth transistor M63 is connected with the fourth OLED OLED43, and the gate of the sixth transistor M63 is connected with a fourth emission control line E4*n* so that the sixth transistor M63 selectively applies the current that flows from the source of the sixth transistor M63 to the drain of the sixth transistor M63, to the fourth OLED OLED43 in accordance with a fourth emission control signal e 4*n* transmitted through the fourth emission control line E4*n* to emit light from the fourth OLED OLED43.

Figure 12:
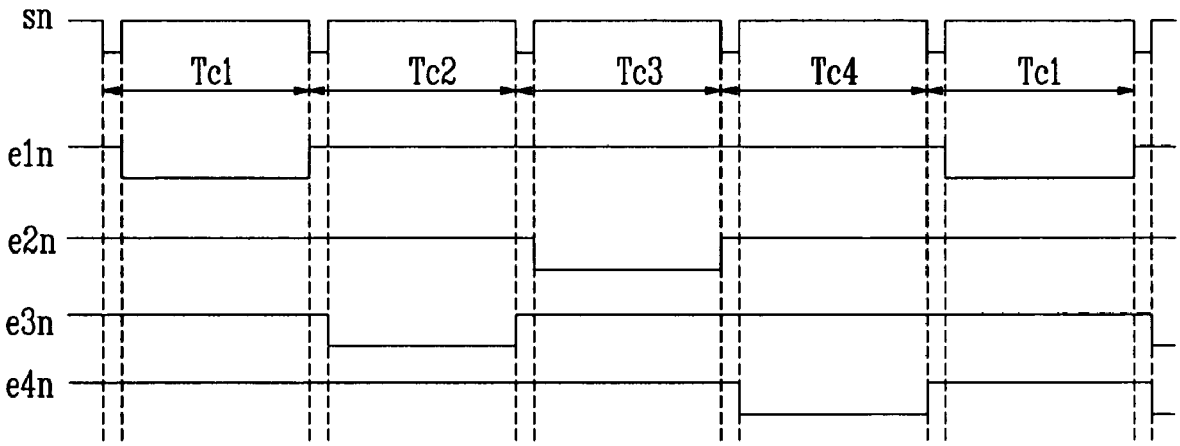
FIG. 12 illustrates waveforms of signals transmitted to the light emitting display that uses the pixel of FIG. 11.

FIG. 12 illustrates waveforms of signals transmitted to the light emitting display that uses the pixel of FIG. 11. Referring to FIG. 12, the pixel is operated by a scan signal sn, a data signal, and first, second, third and fourth emission control signals e1*n* to e4*n*. The scan signal sn and the first to fourth emission control signals e1*n* to e4*n* are periodical signals having first to fourth periods T1 to T4.

In the first period Tc1, the first emission control signal e1*n* is in a low level. In the second period Tc2, the third emission control signal e3*n* is in the low level. In the third period Tc3, the second emission control signal e2*n* is in the low level. In the fourth period Tc4, the fourth emission control signal e 4*n* is in the low level. The scan signal sn is in the low level for a moment at the start point of each period.

In the first period Tc1, a second transistor M23 is turned on by the scan signal sn so that the data signal is transmitted to a second node B3 through the second transistor M23. The pixel power is transmitted to the first electrode of a capacitor Cstc so that a voltage value corresponding to a difference Vdd-Vdata between the pixel power and the data signal is stored in the capacitor Cstc.

The capacitor Cstc applies the voltage corresponding to the difference between the pixel power and the data signal to the gate of a first transistor M13 through the second node B3 so that the first transistor M13 flows a current corresponding to the data signal to a first node A3.

A third transistor M33 is turned on by the first emission control signal e1*n* so that the current flows to the first OLED OLED13.

In the second period Tc2, the voltage value corresponding to the difference between the pixel power source and the data signal is stored in the capacitor Cstc by the scan signal sn and the data signal so that the first transistor M13 flows the current corresponding to the data signal to the first node A3. The fifth transistor M53 is turned on by the third emission control signal e3*n* so that the current flows to the third OLED OLED33.

In the third and fourth periods Tc3 and Tc4, a current is generated as in the first and second periods Tc1 and Tc2, and the current flows to the first node A3. In the third period Tc3, the current flows to the second OLED OLED23 by the second emission control signal e2*n*. In the fourth period Tc4, the current flows to the fourth OLED OLED43 by the fourth emission control signal e4*n*.

Therefore, the first to fourth OLEDs OLED13 to OLED43 sequentially emit light in the order described above.

Figure 13:
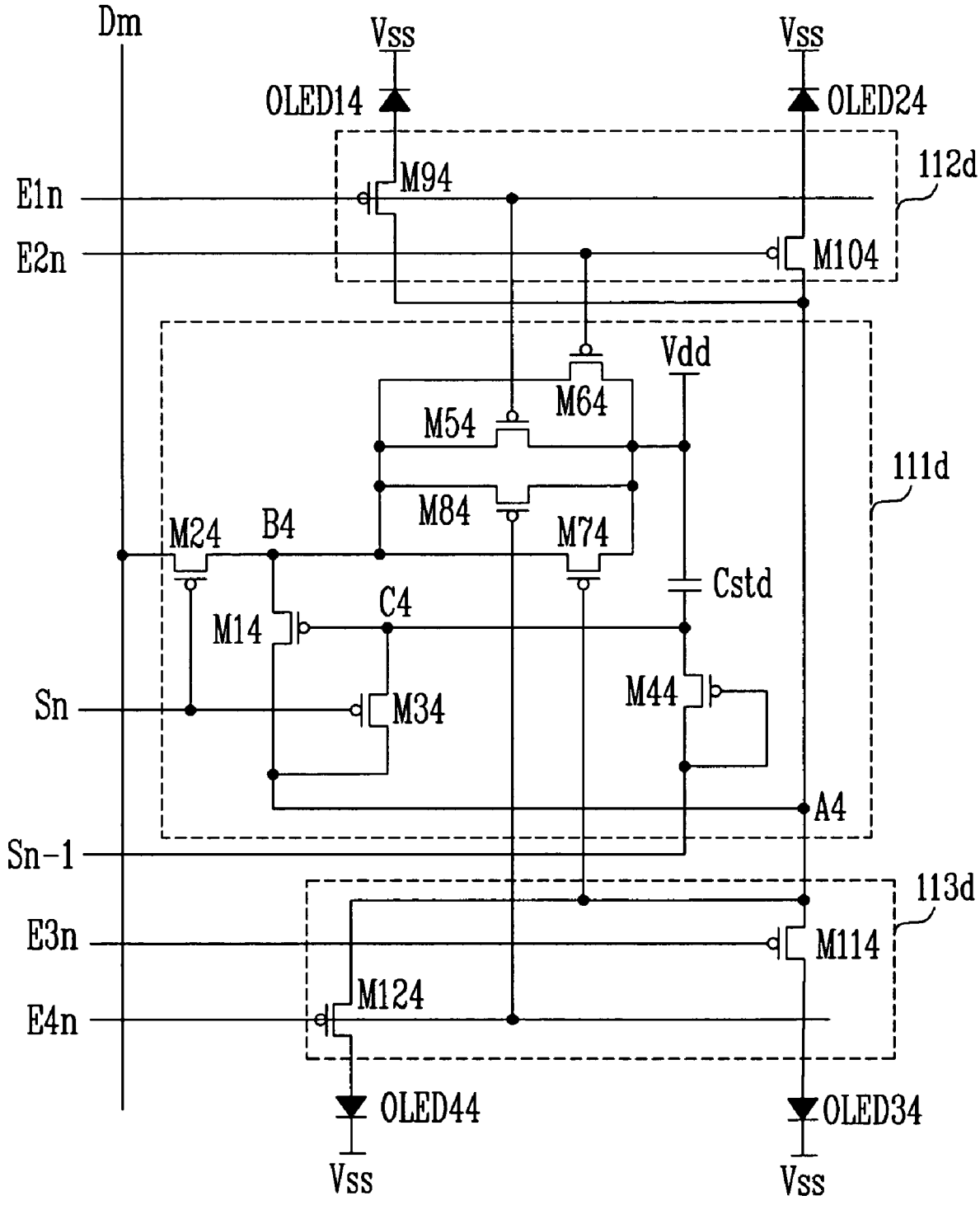
FIG. 13 is a circuit diagram illustrating a first embodiment of a pixel of the light emitting display of FIG. 10.

FIG. 13 is a circuit diagram illustrating a first embodiment of a pixel of the light emitting display of FIG. 10. Referring to FIG. 13, the pixel includes four OLEDs and a pixel circuit (e.g., the pixel circuit 110*c*). The four OLEDs OLED14, OLED24, OLED34, and OLED44 are connected with one pixel circuit. The pixel circuit (e.g., the pixel circuit 110*c*) includes a driving circuit 111*d*, a first switching circuit 112*d*, and a second switching circuit 113*d*.

The driving circuit 111*d* includes first to eighth transistors M14 to M84 and a capacitor Cstd. The first switching circuit 112*d* includes ninth and tenth transistors M94 and M104. The second switching circuit 113*d* includes $11^{th}$ and $12^{th}$ transistors M114 and M124. Each transistor includes a source, a drain, and a gate. The capacitor Cstd includes a first electrode and a second electrode.

Since the drains and the sources of the first to twelfth transistors M14 to M124 have no physical difference, each source and drain may be referred to as a first electrode and a second electrode.

The drain of the first transistor M14 is connected with a first node A4, the source of the first transistor M14 is connected with a second node B4, and the gate of the first transistor M14 is connected with a third node C4 so that a current flows from the second node B4 to the first node A4 in accordance with a voltage of the third node C4.

The source of the second transistor M24 is connected with a data line Dm, the drain of the second transistor M24 is connected with the second node B4, and the gate of the second transistor M24 is connected with a first scan line Sn so that the second transistor M24 performs a switching operation in accordance with a first scan signal sn transmitted through the first scan line Sn to selectively transmit a data signal transmitted through the data line Dm to the second node B4.

The source of the third transistor M34 is connected with the first node A4, the drain of the third transistor M34 is connected with the third node C4, and the gate of the third transistor M34 is connected with the first scan line Sn so that the potential of the first node A4 is made equal to the potential of the third node C4 in accordance with the first scan signal sn transmitted through the first scan line Sn to have an electric current flow through the first transistor M14. Therefore, the first transistor M14 serves as a diode.

The source and gate of the fourth transistor M44 are connected with a second scan line Sn−1 and the drain of the fourth transistor M44 is connected with the third node C4 so that the fourth transistor M44 applies an initializing signal to the third node C4. The initializing signal is a second scan signal sn−1 input to select the row that precedes by one row the row to which the first scan signal sn is input to select, and is received through the second scan line Sn−1. That is, the second scan line Sn−1 refers to the scan line connected with the row that precedes the row to which the first scan line Sn is connected by one row.

The source of the fifth transistor M54 is connected with a pixel power source Vdd, the drain of the fifth transistor M54 is connected with the second node B4, and the gate of the fifth transistor M54 is connected with a first emission control line E1*n* so that the fifth transistor M54 selectively applies a pixel power of the pixel power source Vdd to the second node B4 in accordance with a first emission control signal e1*n* transmitted through the first emission control line E1*n*.

The source of the sixth transistor M64 is connected with the pixel power source Vdd, the drain of the sixth transistor M64 is connected with the second node B4, and the gate of the sixth transistor M64 is connected with a second emission control line E2*n* so that the sixth transistor M64 selectively applies the pixel power of the pixel power source Vdd to the second node B4 in accordance with a second emission control signal e2*n* transmitted through the second emission control line E2*n*.

The source of the seventh transistor M74 is connected with the pixel power source Vdd, the drain of the seventh transistor M74 is connected with the second node B4, and the gate of the seventh transistor M74 is connected with a third emission control line E3*n* so that the seventh transistor M74 selectively applies the pixel power of the pixel power source Vdd to the second node B4 in accordance with a third emission control signal e3*n* transmitted through the third emission control line E3*n*.

The source of the eighth transistor M84 is connected with the pixel power source Vdd, the drain of the eighth transistor M84 is connected with the second node B4, and the gate of the eighth transistor M84 is connected with a fourth emission control line E4*n* so that the eighth transistor M84 selectively applies the pixel power of the pixel power source Vdd to the second node B4 in accordance with a fourth emission control signal e 4*n* transmitted through the fourth emission control line E4*n*.

The source of the ninth transistor M94 is connected with the first node A4, the drain of the ninth transistor M94 is connected with the first OLED OLED14, and the gate of the ninth transistor M94 is connected with the first emission control line E1*n* so that the current that flows through the first node A4 flows to the first OLED OLED14 in accordance with the first emission control signal e1*n* transmitted through the first emission control line El n to emit light from the first OLED OLED14.

The source of the tenth transistor M104 is connected with the first node A4, the drain of the tenth transistor M104 is connected with the second OLED OLED24, and the gate of the tenth transistor M104 is connected with the second emission control line E2*n* so that the current that flows through the first node A4 flows to the second OLED OLED24 in accordance with the second emission control signal e2*n*transmitted through the second emission control line E2*n* to emit light from the second OLED OLED24.

The source of the $11^{th}$ transistor M114 is connected with the first node A4, the drain of the $11^{th}$ transistor M114 is connected with the third OLED OLED34, and the gate of the $11^{th}$ transistor M114 is connected with the third emission control line E3*n* so that the current that flows through the first node A4 flows to the third OLED OLED34 in accordance with the third emission control signal e3*n* transmitted through the third emission control line E3*n* to emit light from the third OLED OLED34.

The source of the $12^{th}$ transistor M124 is connected with the first node A4, the drain of the $12^{th}$ transistor M124 is connected with the fourth OLED OLED44, and the gate of the $12^{th}$ transistor M124 is connected with the fourth emission control line E4*n* so that the current that flows through the fourth node A4 flows to the fourth OLED OLED44 in accordance with the fourth emission control signal e 4*n* transmitted through the fourth emission line E4*n* to emit light from the fourth OLED OLED44.

The first electrode of the capacitor Cstd is connected with the pixel power source Vdd and the second electrode of the capacitor Cstd is connected with the third node C4 so that the capacitor Cstd is initialized by the initializing signal transmitted to the third node C4 through the fourth transistor M44, and the voltage corresponding to the data signal is stored by the capacitor Cstd and then transmitted to the third node C4. Therefore, the gate voltage of the first transistor M14 is maintained for a predetermined time.

Figure 14:
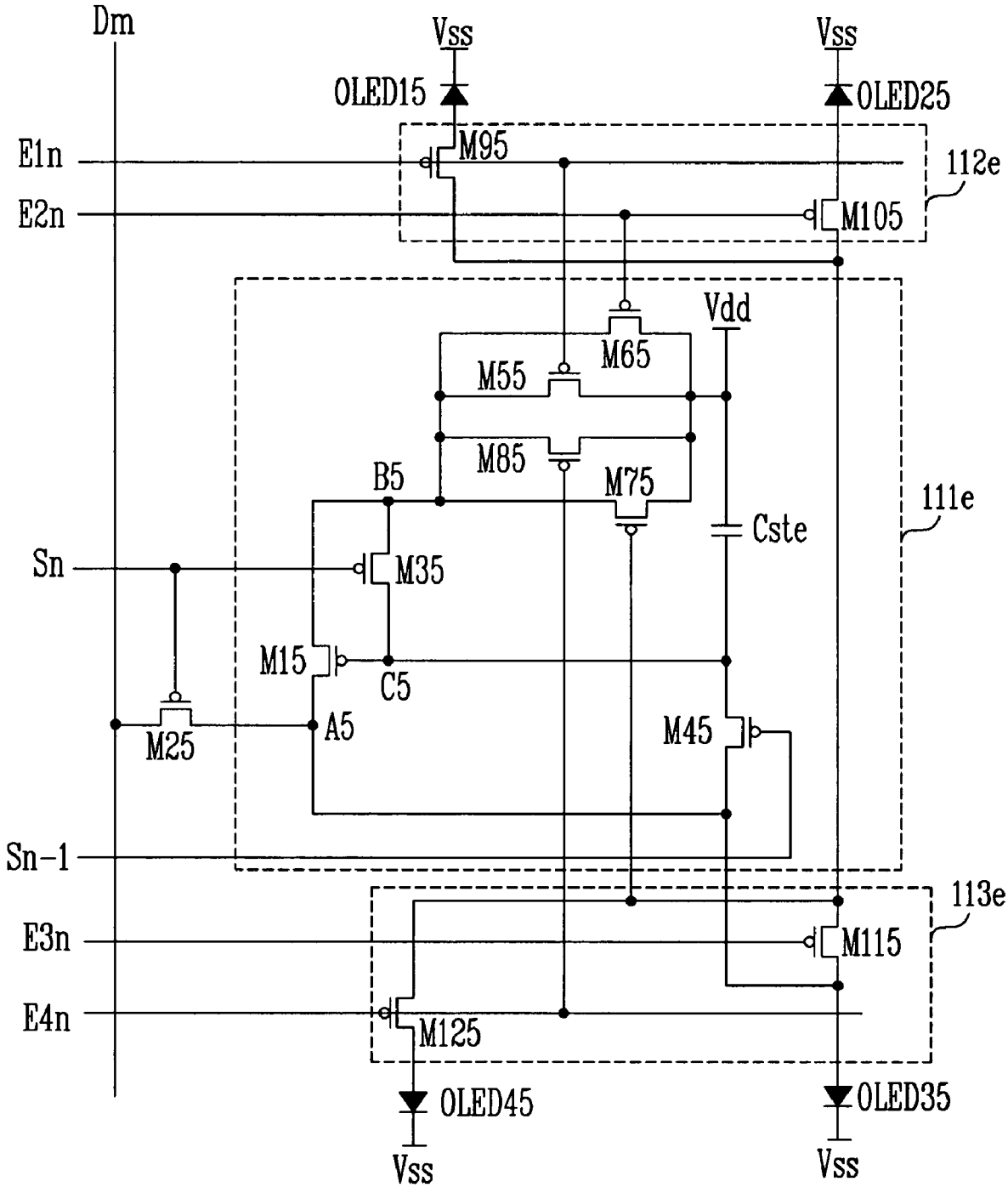
FIG. 14 is a circuit diagram illustrating a second embodiment of a pixel of the light emitting display of FIG. 10.

FIG. 14 is a circuit diagram illustrating a second embodiment of a pixel of the light emitting display of FIG. 10. Referring to FIG. 14, the pixel includes four OLEDs and a pixel circuit (e.g., the pixel circuit 110*c*). The four OLEDs OLED15, OLED25, OLED35, and OLED45 are connected with one pixel circuit. The pixel circuit (e.g., the pixel circuit 110*c*) includes a driving circuit 111*e*, a first switching circuit 112*e*, and a second switching circuit 113*e*.

The driving circuit 111 e includes first to eighth transistors M15 to M85 and a capacitor Cste. The first switching circuit 112*e* includes ninth and tenth transistors M95 and M105. The second switching circuit 113*e* includes $11^{th}$ and $12^{th}$ transistors M115 and M125. Each transistor includes a source, a drain, and a gate. The capacitor Cste includes a first electrode and a second electrode.

Since the drains and sources of the first to $12^{th}$ transistors M15 to M125 have no physical difference, each source and drain may be referred to as a first electrode and a second electrode.

The drain of the first transistor M15 is connected with a first node A5, the source of the first transistor M15 is connected with a second node B5, and the gate of the first transistor M15 is connected with a third node C5 so that a current flows from the second node B5 to the first node A5 in accordance with a voltage of the third node C5.

The source of the second transistor M25 is connected with the data line Dm, the drain of the second transistor M25 is connected with the first node A5, and the gate of the second transistor M25 is connected with a first scan line Sn so that the second transistor M25 performs a switching operation in accordance with a first scan signal sn transmitted through the first scan signal Sn to selectively transmit a data signal transmitted through a data line Dm to the first node A5.

The source of the third transistor M35 is connected with the second node B5, the drain of the third transistor M35 is connected with the third node C5, and the gate of the third transistor M35 is connected with the first scan line Sn so that the potential of the second node B5 is made equal to the potential of the third node C5 in accordance with the first scan signal sn transmitted through the first scan line Sn to have an electric current flow through the first transistor M15. Therefore, the first transistor M15 serves as a diode.

The source of the fourth transistor M45 is connected with an anode electrode of an OLED (e.g., the OLED 35), the drain of the fourth transistor M45 is connected with the third node C5, and the gate of the fourth transistor M45 is connected with a second scan line Sn−1 so that the fourth transistor M45 applies a voltage when no current flows to the first to fourth OLEDs OLED15 to OLED45 to the third node C5 in accordance with a second scan signal sn−1. At this time, the voltage transmitted to the third node C5 in accordance with the second scan signal sn−1 is used as an initializing signal for initializing the capacitor Cste.

The source of the fifth transistor M55 is connected with a pixel power source Vdd, the drain of the fifth transistor M55 is connected with the second node B5, and the gate of the fifth transistor M55 is connected with a first emission control line E1*n* so that the fifth transistor M55 selectively applies a pixel power of the pixel power source Vdd to the second node B5 in accordance with a first emission control signal e1*n* transmitted through the first emission control line E1*n*.

The source of the sixth transistor M65 is connected with the pixel power source Vdd, the drain of the sixth transistor M65 is connected with the second node B5, and the gate of the sixth transistor M65 is connected with a second emission control line E2*n* so that the sixth transistor M65 selectively applies the pixel power of the pixel power source Vdd to the second node B5 in accordance with a second emission control signal e2*n* transmitted through the second emission control line E2*n*.

The source of the seventh transistor M75 is connected with the pixel power source line Vdd, the drain of the seventh transistor M75 is connected with the second node B5, and the gate of the seventh transistor M75 is connected with a third emission control line E3*n* so that the seventh transistor M75 selectively applies the pixel power of the pixel power source Vdd to the second node B5 in accordance with a third emission control signal e3*n* transmitted through the third emission control line E3*n*.

The source of the eighth transistor M85 is connected with the pixel power source Vdd, the drain of the eighth transistor M85 is connected with the second node B5, and the gate of the eighth transistor M85 is connected with a fourth emission control line E4*n* so that the eighth transistor M85 selectively applies the pixel power source to the second node B5 in accordance with a fourth emission control signal e4*n* transmitted through the fourth emission control line E4*n*.

The source of the ninth transistor M95 is connected with the first node A5, the drain of the ninth transistor M95 is connected with the first OLED OLED15, and the gate of the ninth transistor M95 is connected with the first emission control line E1*n* so that the current that flows through the first node A5 flows to the first OLED OLED15 in accordance with the first emission control signal e1*n* transmitted through the first emission control line El n to emit light from the first OLED OLED15.

The source of the tenth transistor M105 is connected with the first node A5, the drain of the tenth transistor M105 is connected with the second OLED OLED25, and the gate of the tenth transistor M105 is connected with the second emission control line E2*n* so that the current that flows through the first node A5 flows to the second OLED OLED25 in accordance with the second emission control signal e2*n*transmitted through the second emission control line E2*n* to emit light from the second OLED OLED25.

The source of the $11^{th}$ transistor M15 is connected with the first node A5, the drain of the $11^{th}$ transistor M115 is connected with the third OLED OLED35, and the gate of the $11^{th}$ transistor M115 is connected with the third emission control line E3*n* so that the current that flows through the first node A5 flows to the third OLED OLED35 in accordance with the third emission control signal e3*n* transmitted through the third emission control line E3*n* to emit light from the third OLED OLED35.

The source of the $12^{th}$ transistor M125 is connected with the first node A5, the drain of the $12^{th}$ transistor M125 is connected with the fourth OLED OLED45, and the gate of the $12^{th}$ transistor M125 is connected with the fourth emission control line e 4*n* so that the current that flows through the fourth node A5 flows to the fourth OLED OLED45 in accordance with the fourth emission control signal e 4*n* transmitted through the fourth emission control line E4*n* to emit light from the fourth OLED OLED45.

The first electrode of the capacitor Cste is connected with the pixel power source Vdd, and the second electrode of the capacitor Cste is connected with the third node C5 so that the capacitor Cste is initialized by the initializing signal transmitted to the third node C5 through the fourth transistor M45 and so that the voltage corresponding to the data signal is stored by the capacitor Cste and then transmitted to the third node C5. Therefore, the gate voltage of the first transistor M1 5 is maintained for a predetermined time.

Figure 15:
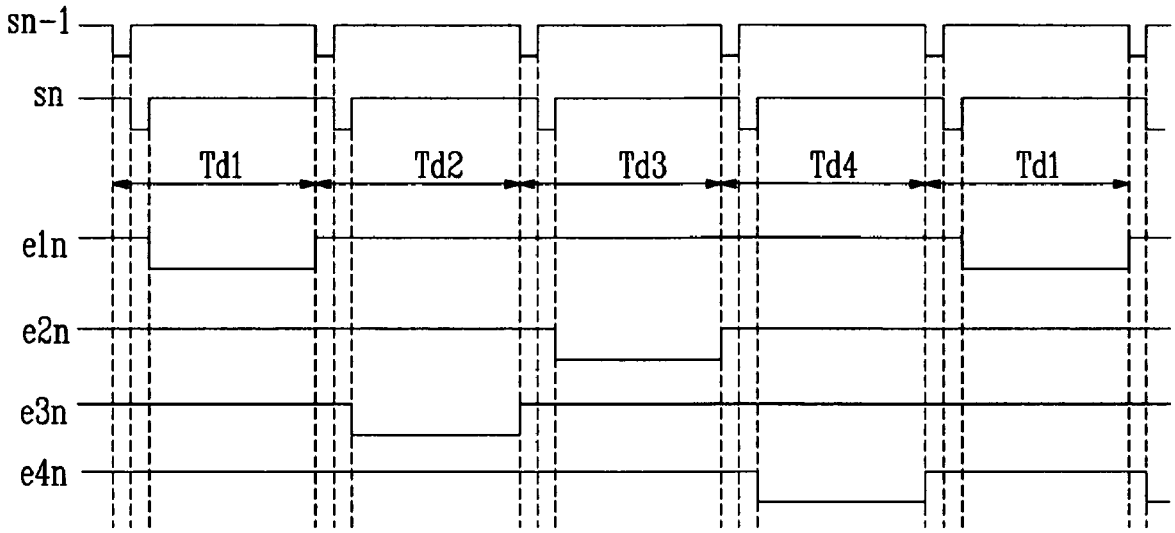
FIG. 15 illustrates waveforms of signals transmitted to the light emitting display that uses the pixels of FIGS. 13 and 14.

FIG. 15 illustrates waveforms of signals transmitted to the light emitting display that uses the pixels illustrated in FIGS. 13 and 14. Referring to FIG. 15, the pixel is operated by first and second scan signals sn and sn−1, a data signal, and first, second, third, and fourth emission control signals e1*n*, e2*n*, e3*n*, and e4*n*. The first and second scan signals sn and sn−1 and the first to fourth emission control signals e1*n* to e4*n* are periodical signals having first to fourth periods Td1 to Td4.

In the first period Td1, the first emission control signal e1*n* is in a low level. In the second period Td2, the third emission control signal e3*n* is in the low level. In the third period Td3, the second emission control signal e2*n* is in the low level. In the fourth period Td4, the fourth emission control signal e4*n* is in the low level. The second scan signal sn−1 is the scan signal for selecting a line that precedes the line to which the first scan signal sn is input to select. The first scan signal sn and the second scan signal sn−1 are sequentially in the low level for a moment at the starting point of each period.

In the first period Td1, a fourth transistor M4 (e.g., M44 and M45) is turned on by the second scan signal sn−1, and an initializing signal is transmitted to the capacitor Cst (e.g., Cstd or Cste) through the fourth transistor M4 to initialize the capacitor Cst. A second transistor M2 (e.g., M24 or M25) and a third transistor M3 (e.g., M34 and M35) are turned on by the first scan signal sn so that the potential of a first node A4 or a second node B5 is made equal to the potential of a third node C (e.g., C4 or C5) to have an electric current flow through a first transistor M1 (e.g., M14 or M15). Therefore, the first transistor M1 (e.g., M14 or M15) is connected like a diode. The data signal is applied to a second node B4 or a second node A5 through the second transistor M2 (e.g., M24 or M25). Therefore, the data signal is transmitted to a second electrode of the capacitor Cst (e.g., Cstd or Cste) through the second transistor M2 (e.g., M24 or M25), the first transistor M1 (e.g., or M14 or M15), and the third transistor M3 (e.g., M34 or M35) so that the voltage corresponding to difference between the data signal and the threshold voltage is transmitted to the second electrode of the capacitor Cst (e.g., Cstd or Cste).

After the first scan signal sn is transited to the high level, when the first emission control signal e1*n* is transited to the low level and is maintained in the low level for a predetermined time, a fifth transistor M5 (e.g., M54 or M55) and a ninth transistor M9 (e.g., M94 or M95) are turned on by the first emission control signal e1*n* so that the voltage corresponding to the EQUATION 1 is applied between the gate and the source of the first transistor M1 (e.g., M14 or M15).

The ninth transistor M9 (e.g., M94 or M95) is turned on so that the current corresponding to the EQUATION 2 flows to an OLED OLED1 (E.G., OLED14 or OLED15).

Therefore, referring now to FIGS. 13 and 14 and EQUATION 2, the current flows to the first OLEDs OLED14 and OLED15 regardless of the threshold voltages of the first transistors M14 and M15.

In the second period Td2, the voltage value corresponding to the difference between the pixel power source and the data signal is stored in the capacitor Cst (e.g., Cstd or Cste) by the first and second scan signals sn and sn−1, and the data signal and the voltage corresponding to the EQUATION 1 are transmitted to the first transistor M1 (e.g., M14 or M15). A seventh transistor M7 (e.g., M74 or M75) and an $11^{th}$ transistor M11 (e.g., M114 or M115) are turned on by a third emission control signal e3*n* and a current corresponding to the EQUATION 2 flows through a third OLED OLED3 (e.g., OLED34 or OLED35).

In the third and fourth periods Td3 and Td4, currents are generated substantially the same as in the first and second periods Td1 and Td2. That is, in the third period Td3, a sixth transistor M6 (e.g., M64 or M65) is turned on by a second emission control signal e2*n* so that a current flows to a second OLED OLED2 (e.g., OLED24 or OLED25). In the fourth period Td4, an eighth transistor M8 (e.g., M84 or M85) and an $12^{th}$ transistor M12 (e.g., M124 or M125) are turned on by a fourth emission control signal e4*n* so that a current flows to a fourth OLED OLED4 (e.g., OLED44 or OLED45).

Therefore, the first to fourth OLEDs OLED1 to OLED4 (e.g., OLED14 to OLED44 or OLED15 to OLED45) sequentially emit light in the order described above.

FIGS. 16A to 16D illustrate emission processes of the light emitting display of FIG. 9. In the image display unit 100*b*, three pixel circuits are vertically arranged so that twelve OLEDs are arranged in the form of a 2×6 matrix. A top pixel circuit, a central pixel circuit, and a bottom pixel circuit may be referred to as a first pixel circuit, a second pixel circuit, and a third pixel circuit. Referring to FIGS. 16A to 16D, since all four OLEDs are connected with one pixel circuit to sequentially emit light for one frame, one frame may be divided into four sub-fields.

As first OLED OLED13 and the third OLED OLED33 connected with one pixel circuit among the two pixel circuits adjacent to one data line receive a red data signal R to emit red light, and the second OLED OLED23 and the fourth OLED OLED43 receive a green data signal G to emit green light, the first OLED OLED13 and the third OLED OLED33 connected with the other pixel circuit among the two circuits receive the green data signal G to emit green light, and the second OLED OLED23 and the fourth OLED OLED43 receive the red data signal R to emit red light. The red data and the green data are alternately transmitted through one data line.

Figure 16A:
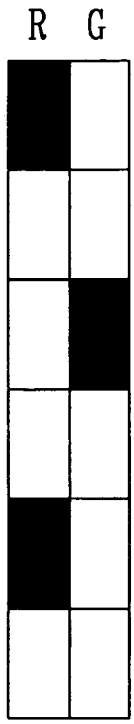
FIGS. 16A 16B, 16C and 16D illustrate emission processes of the light emitting display of FIG. 9.
Figure 16C:
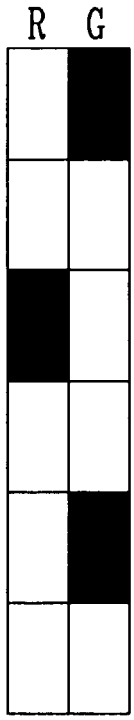

FIG. 16A illustrates the first sub-field among the four sub-fields. As illustrated in FIG. 16A, the first pixel circuit and the third pixel circuit emit red light through the first OLED OLED13 receiving the red data and the second pixel circuit emits green light through the first OLED OLED13 receiving the green data so that the red and green light components are simultaneously emitted.

Figure 16B:
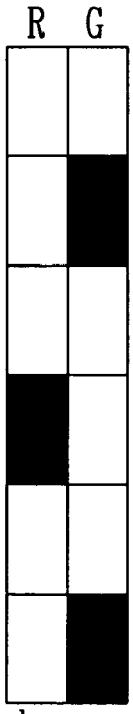
Figure 16D:
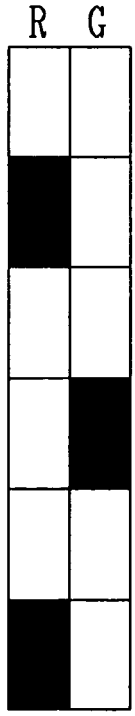

In FIG. 16B that illustrates the second sub-field, the first pixel circuit and the third pixel circuit emit green light through the third OLED OLED33 receiving the green data and the second pixel circuit emits red light through the third OLED OLED33 receiving the red data so that the red and green light components are simultaneously emitted. Also, in the third and fourth sub-fields illustrated in FIGS. 16C and 16D, the red and green light components are simultaneously emitted.

When only one colored light is emitted from one sub-field, color breakup is generated. However, since the red and green light components are simultaneously emitted from each sub-field and, considering the entire image display unit, red, green, and blue light components are simultaneously emitted from each sub-field, color breakup can be prevented by the present invention. The light emitting display of FIG. 10 operates substantially the same as described above for the display of FIG. 9 so that the display of FIG. 10 can also prevent the generation of color breakup.

As described above, according to a light emitting display of the present invention, threshold voltages of transistors are compensated so that uniform currents flow to OLEDs regardless of a deviation in the threshold voltages, thus making brightness more uniform. Also, a plurality of OLEDs emit light through one pixel circuit so that the number of data lines and the number of pixel power lines can be reduced.

In particular, since four OLEDs are connected with one pixel circuit of one embodiment, it is possible to reduce the number of pixel circuits of a light emitting display. Therefore, pixel circuits required can be less than a conventional display where one pixel is connected with one OLED. Since the number of pixel circuits is reduced, it is also possible to reduce the number of scan lines, data lines, and emission control lines that transmit signals. Therefore, it is possible to reduce the size of a scan driver and the size of a data driver, thereby aming it is possible to reduce unnecessary space. Also, as the number of wiring lines is reduced, the aperture ratio of the light emitting display increases.

Also, as the number of data lines is reduced, it is possible to reduce the size of the data driver and to thus reduce a manufacturing cost of the light emitting display.

Also, it is possible to control the emission orders of the OLEDs and to thus prevent the color breakup of the light emitting display.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. A light emitting display comprising:

first and second scan lines arranged in a row direction to transmit first and second scan signals;

a data line arranged in a column direction to transmit a data signal;

an image display unit including first and second emission control lines arranged in the row direction to transmit first and second emission control signals, respectively, and a pixel formed in a region defined by the first and second scan lines and the data line, wherein the pixel comprises:

a driving circuit for receiving the first and second scan signals, the data signal, the first and second emission control signals, and a first power of a first power source to drive a current;

a switching circuit connected with the driving circuit to receive the current, the switching circuit for selectively applying the current in accordance with the first and second emission control signals; and first and second organic light emitting diodes (OLEDs) positioned on two different rows of the image display unit and connected with the switching circuit to receive the current in accordance with an operation of the switching circuit and to emit light, wherein the driving circuit comprises:

a first transistor for receiving the first power of the first power source and for supplying the current to the first and second OLEDs, the current corresponding to a voltage applied to a gate of the first transistor;

a second transistor for selectively applying a data signal to a first electrode of the first transistor in accordance with the first scan signal;

a third transistor for selectively forming an electrical connection between a second electrode of the first transistor and the gate of the first transistor in accordance with the first scan signal;

a capacitor for storing the voltage applied to the gate of the first transistor while the data signal is applied to the first electrode of the first transistor and for maintaining the stored voltage at the gate of the first transistor for a predetermined time period when at least one of the first and second OLEDs emits light;

a fourth transistor for selectively applying an initializing signal to the capacitor in accordance with the second scan signal;

a fifth transistor for selectively applying the first power of the first power source to the first transistor in accordance with the first emission control signal; and a sixth transistor for selectively applying the first power of the first power source to the first transistor in accordance with the second emission control signal.

2. The light emitting display as claimed in claim 1, wherein the switching circuit comprises a first switching circuit and a second switching circuit, wherein the first switching circuit comprises a seventh transistor for selectively applying the current to the first OLED in accordance with the first emission control signal, and wherein the second switching circuit comprises an eighth transistor for selectively applying the current to the second OLED in accordance with the second emission control signal.

3. The light emitting display as claimed in claim 2, wherein the first emission control line is formed on the driving circuit, and wherein the second emission control line is formed adjacent to the driving circuit.

4. The light emitting display as claimed in claim 1, wherein a level of the voltage applied to the gate of the first transistor is a difference between a voltage of the data signal and a threshold voltage of the first transistor obtained by the first power of the first power source.

5. The light emitting display as claimed in claim 1, wherein the initializing signal is the second scan signal of the second scan line, the second scan line preceding the first scan line to which the first scan signal is input.

6. The light emitting display as claimed in claim 1, wherein the initializing signal is a voltage applied to at least one the first and second OLEDs while no current flows to first and second OLEDs from the first transistor.

7. The light emitting display as claimed in claim 1, wherein the first and second OLEDs emit light of a same color.

8. The light emitting display as claimed in claim 1, wherein the first and second OLEDs are organic light emitting diodes.

9. A light emitting display comprising:

first and second scan lines arranged in a row direction to transmit first and second scan signals;

a data line arranged in a column direction to transmit a data signal;

an image display unit including first and second emission control lines arranged in the row direction to transmit first and second emission control signals, respectively, and a pixel formed in a region defined by the first and second scan lines and the data line, wherein the pixel comprises:

a driving circuit for receiving the first and second scan signals, the data signal, the first and second emission control signals, and a first power of a first power source to drive a current;

a switching circuit connected with the driving circuit to receive the current, the switching circuit for selectively applying the current in accordance with the first and second emission control signals; and first and second organic light emitting diodes (OLEDs) positioned on two different rows of the image display unit and connected with the switching circuit to receive the current in accordance with an operation of the switching circuit and to emit light, wherein the driving circuit comprises:

a first transistor having first and second electrodes connected with first and second nodes, respectively, and having a third electrode connected with a third node;

a second transistor having first and second electrodes connected with the data line and the second node, respectively, and having a third electrode connected with the first scan line;

a third transistor having first and second electrodes connected with the first and third nodes, respectively, and having a third electrode connected with the first scan line;

a fourth transistor having first and second electrodes connected with the third node and an initializing signal line, respectively, and having a third electrode connected with the second scan line; and a capacitor having a first electrode connected with the first power source and a second electrode connected with the third node;

a fifth transistor having first and second electrodes connected with the second node and the first power source, respectively, and having a third electrode connected with the first emission control line; and a sixth transistor having first and second electrodes connected with the second node and the first power source, respectively, and having a third electrode connected with the second emission control line.

10. The light emitting display as claimed in claim 9, wherein the switching circuit comprises a first switching circuit and a second switching circuit, wherein the first switching circuit comprises a seventh transistor having first and second electrodes connected with the first node and the first OLED, respectively, and having a third electrode connected with the first emission control line, and wherein the second switching circuit comprises an eighth transistor having first and second electrodes connected with the first node and the second OLED, respectively, and having a third electrode connected with the second emission control line.

11. The light emitting display as claimed in claim 9, wherein the initializing signal line transmits a voltage applied to at least one of the first and second OLEDs.

12. The light emitting display as claimed in claim 9, wherein the initializing signal line is connected with the second scan line, the second scan line preceding the first scan line.

13. The light emitting display as claimed in claim 9, wherein the first and second OLEDs emit light of a same color.

14. A light emitting display comprising:

first and second scan lines arranged in a row direction to transmit first and second scan signals;

a data line arranged in a column direction to transmit a data signal;

an image display unit including first and second emission control lines arranged in the row direction to transmit first and second emission control signals, respectively, and a pixel formed in a region defined by the first and second scan lines and the data line, wherein the pixel comprises:

a driving circuit for receiving the first and second scan signals, the data signal, the first and second emission control signals, and a first power of a first power source to drive a current;

a switching circuit connected with the driving circuit to receive the current, the switching circuit for selectively applying the current in accordance with the first and second emission control signals; and first and second organic light emitting diodes (OLEDs) positioned on two different rows of the image display unit and connected with the switching circuit to receive the current in accordance with an operation of the switching circuit and to emit light, wherein the driving circuit comprises:

a first transistor having first and second electrodes connected with first and second nodes, respectively, and having a third electrode connected with a third node;

a second transistor having first and second electrodes connected with a data line and the first node, respectively, and having a third electrode connected with the first scan line;

a third transistor having first and second electrodes connected with the second and third nodes, respectively, and having a third electrode connected with the first scan line;

a fourth transistor whose first and second electrodes connected with the third node and an initializing signal line, respectively, and having a third electrode connected with a second scan line; and a capacitor having a first electrode connected with the first power source and a second electrode connected with the third node;

a fifth transistor having first and second electrodes connected with the second node and the first power source, respectively, and having a third electrode connected with the first emission control line; and a sixth transistor having first and second electrodes connected with the second node and the first power source, respectively, and having a third electrode connected with the second emission control line.

15. The light emitting display as claimed in claim 14, wherein the switching circuit comprises a first switching circuit and a second switching circuit, wherein the first switching circuit comprises a seventh transistor having first and second electrodes connected with the first node and the first OLED, respectively, and having a third electrode connected with the first emission control line, and wherein the second switching circuit comprises an eighth transistor having first and second electrodes connected with the first node and the second OLED, respectively, and having a third electrode connected with the second emission control line.

16. The light emitting display as claimed in claim 14, wherein the initializing signal line transmits a voltage applied to at least one of the first and second OLEDs.

17. The light emitting display as claimed in claim 14, wherein the initializing signal line is connected with the second scan line, the scan line preceding the first scan line.

18. The light emitting display as claimed in claim 14, wherein the first and second OLEDs emit light of a same color.

19. A pixel comprising:

first, second, third, and fourth organic light emitting diodes (OLEDs);

a driving circuit commonly connected with the first, second, third, and fourth OLEDs to drive the first, second, third, and fourth OLEDs; and a switching circuit connected between the first, second, third, and fourth OLEDs and the driving circuit to sequentially control the driving of the first, second, third, and fourth OLEDs, wherein the driving circuit comprises:

a first transistor for receiving a first power of a first power source and for supplying a current in accordance with a first voltage corresponding to the data signal;

a second transistor for receiving a first scan signal to selectively apply the data signal to the first transistor;

a capacitor for storing the first voltage for a predetermined time;

a third transistor for receiving the first scan signal to selectively connect the first transistor to serve as a diode;

a fourth transistor for selectively applying an initializing signal in accordance with a second scan signal to initialize the capacitor;

a fifth transistor for selectively applying the first power of the first power source to the first transistor in accordance with a first emission control signal;

a sixth transistor for selectively applying the first power of the first power source to the first transistor in accordance with a second emission control signal;

a seventh transistor for selectively applying the first power of the first power source to the first transistor in accordance with a third emission control signal; and an eighth transistor for selectively applying the first power of the first power source to the first transistor in accordance with a fourth emission control signal.

20. The pixel as claimed in claim 19, wherein the switching circuit comprises:

a first switching circuit for selectively applying the current in accordance with the first and second emission control signals; and a second switching circuit for selectively applying the current in accordance with the third and fourth emission control signals.

21. The pixel as claimed in claim 19, wherein the first, second, third, and fourth emission control signals are periodical signal having first, second, third, and fourth time periods, wherein the first and third emission control signals maintain different voltage levels in the first and second time periods and are repeatedly in a same voltage level in the third and fourth time periods, and wherein the second and fourth emission control signals are repeatedly in a same voltage level in the first and second time periods and maintain different voltage levels in the third and fourth time periods.

22. The pixel as claimed in claim 20, wherein the first switching circuit comprises:

a ninth transistor for selectively applying the current to the first OLED in accordance with the first emission control signal; and a tenth transistor for selectively applying the current to the second OLED in accordance with the second emission control signal, and wherein the second switching circuit comprises:

an $11^{th}$ transistor for selectively applying the current to the third OLED in accordance with the third emission control signal; and a $12^{th}$ transistor for selectively applying the current to the fourth OLED in accordance with the fourth emission control signal.

23. The pixel as claimed in claim 19, wherein the initializing signal is the second scan signal.

24. The pixel as claimed in claim 19, wherein the initializing signal is a voltage applied to at least one of the first, second, third, and fourth OLEDs while no current flows through the first, second, third, and fourth OLEDs.

25. A light emitting display comprising:

an image display unit including a plurality of pixels;

a data driving part for transmitting data signals to the pixels; and a scan driver for transmitting scan signals and emission control signals to the pixels, wherein each of the pixels comprises:

first, second, third, and fourth organic light emitting diodes (OLEDs);

a driving circuit commonly connected with the first, second, third, and fourth OLEDs to drive the first, second, third, and fourth OLEDs; and a switching circuit connected between the first, second, third, and fourth OLEDs and the driving circuit to sequentially control the driving of the first, second, third, and fourth OLEDs, wherein the driving circuit comprises:

a first transistor for receiving a first power of a first power source and for supplying a current in accordance with a first voltage corresponding to the data signal;

a second transistor for receiving a first scan signal of the scan signals to selectively apply the data signal to the first transistor;

a capacitor for storing the first voltage for a predetermined time;

a third transistor for receiving the first scan signal to selectively connect the first transistor to serve as a diode;

a fourth transistor for selectively applying an initializing signal in accordance with a second scan signal of the scan signals to initialize the capacitor;

a fifth transistor for selectively applying the first power of the first power source to the first transistor in accordance with a first emission control signal of the emission control signals;

a sixth transistor for selectively applying the first power of the first power source to the first transistor in accordance with a second emission control signal of the emission control signals;

a seventh transistor for selectively applying the first power of the first power source to the first transistor in accordance with a third emission control signal of the emission control signals; and an eighth transistor for selectively applying the first power of the first power source to the first transistor in accordance with a fourth emission control signal of the emission control signals.

26. The light emitting display as claimed in claim 25, wherein the switching circuit comprises:

a first switching circuit for selectively applying the current in accordance with the first and second emission control signals; and a second switching circuit for selectively applying the current in accordance with the third and fourth emission control signals.

27. The light emitting display as claimed in claim 26, wherein the first switching circuit comprises:

a ninth transistor for selectively applying the current to the first OLED in accordance with the first emission control signal; and a tenth transistor for selectively applying the current to the second OLED in accordance with the second emission control signal, and wherein the second switching circuit comprises:

an $11^{th}$ transistor for selectively applying the current to the third OLED in accordance with the third emission control signal; and a $12^{th}$ transistor for selectively applying the current to the fourth OLED in accordance with the fourth emission control signal.

28. The light emitting display as claimed in claim 25, wherein, among the plurality of pixels, in a first pixel and a second pixel adjacent to each other and receiving at least one of the data signals through a same one of the data lines, an emission order of the first and second OLEDs of the first pixel is different from an emission order of the first and second OLEDs of the second pixel and an emission order of the third and fourth OLEDs of the first pixel is different from an emission order of the third and fourth OLEDs of the second pixel.

29. The light emitting display as claimed in claim 25, wherein the second scan signal is transmitted to one scan line preceding another scan line to which the first scan signal is transmitted.

30. The light emitting display as claimed in claim 25, wherein the data driver sequentially outputs two data signals of the data signals, the two data signals having information on different colors.

* * * * *

UNITED STATES PATENT AND TRADEMARK OFFICE

CERTIFICATE OF CORRECTION

PATENT NO. : 7,542,019 B2
APPLICATION NO. : 11/274041
DATED : June 2, 2009
INVENTOR(S) : Sung Cheon Park et al.

It is certified that error appears in the above-identified patent and that said Letters Patent is hereby corrected as shown below:

In the Claims

| | |
|---|---|
| Column 21, Claim 6, line 33 | After "one" Insert -- of -- |
| Column 21, Claim 6, line 34 | After "to" Insert -- the -- |
| Column 24, Claim 21, line 32 | Delete "signal" Insert -- signals -- |

Signed and Sealed this

Fifteenth Day of June, 2010

David J. Kappos

David J. Kappos
*Director of the United States Patent and Trademark Office*